US006406116B1

(12) United States Patent
Katakura et al.

(10) Patent No.: US 6,406,116 B1
(45) Date of Patent: Jun. 18, 2002

(54) PRINTING TECHNIQUE USING PLURALITY OF DIFFERENT DOTS CREATED IN DIFFERENT STATES WITH EQUIVALENT QUANTITY OF INK

(75) Inventors: Takahiro Katakura; Tomohiro Sayama, both of Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 8 days.

(21) Appl. No.: 09/705,869

(22) Filed: Nov. 6, 2000

Related U.S. Application Data

(63) Continuation of application No. PCT/JP00/01311, filed on Mar. 3, 2000.

(30) Foreign Application Priority Data

| | | |
|---|---|---|
| Mar. 5, 1999 | (JP) | 11-58131 |
| Mar. 5, 1999 | (JP) | 11-58141 |
| Mar. 18, 1999 | (JP) | 11-73546 |

(51) Int. Cl.[7] ..... B41J 2/205
(52) U.S. Cl. ..... 347/15
(58) Field of Search ..... 347/43, 15, 11

(56) References Cited

U.S. PATENT DOCUMENTS 4,631,548 A * 12/1986 Milbrandt ..... 347/43
5,844,583 A * 12/1998 Onishi et al. ..... 347/16
6,024,438 A * 2/2000 Koike et al. ..... 347/43

FOREIGN PATENT DOCUMENTS

| | | |
|---|---|---|
| EP | 0858892 | 8/1998 |
| JP | 63-34145 | 2/1988 |
| JP | 63-286357 | 11/1988 |
| JP | 3-189166 | 8/1991 |
| JP | 4-28547 | 1/1992 |
| JP | 5-124218 | 5/1993 |
| JP | 10-193587 | 7/1998 |
| JP | 10-193649 | 7/1998 |

* cited by examiner

*Primary Examiner*—Thinh Nguyen
(74) *Attorney, Agent, or Firm*—Oblon, Spivak, McClelland, Maier & Neustadt, P.C.

(57) ABSTRACT

An ink jet printer has a specific unit that is capable of splitting a dot into a plurality of divisions. The arrangement of splitting an ejected ink droplet into a plurality of parts to create a split dot having a plurality of divisions at a plurality of different positions in one pixel advantageously decreases the quantity of ink per position. This reduces penetration of ink in the direction of the depth of printing paper. Under the condition of a fixed quantity of ink, the split dot has a greater total area than the area of a single dot and ensure a higher resulting expressed density. This arrangement ensures multi-tone expression without changing the total quantity of ink ejected in each pixel.

29 Claims, 29 Drawing Sheets

FLIGHT SPEED,DOT AREA

PRINTING TECHNIQUE USING PLURALITY OF DIFFERENT DOTS CREATED IN DIFFERENT STATES WITH EQUIVALENT QUANTITY OF INK

This application is a continuation of PCT/JP00/01311 filed Mar. 3, 2000.

TECHNICAL FIELD

The present invention relates to a technique of ejecting ink to create dots and print a multi-tone image. More specifically the present invention pertains to a printing technique using a plurality of different dots created in different states with a substantially e equivalent quantity of ink.

BACKGROUND ART

A diversity of printers have widely been used as output devices to print multi-color, multi-tone images processed by the computer. One of such printers is an ink jet printer that creates dots with several color inks ejected from a plurality of nozzles provided on a print head, so as to record an image. The ink jet printer generally enables expression of only two tones, that is, a dot-on state and a dot-off state, in each pixel. The ink jet printer accordingly carries out the halftone processing, which expresses multiple tones of original image data by a distribution of dots, prior to printing an image.

Multi-valued printers that enable expression of at least trinary tones in each pixel are one of the proposed techniques to attain richer tone expression. The multi-valued printers include printers using a plurality of inks having different densities with regard to an identical hue and printers using variable quantities of ink to create dots. The variable-ink quantity printers include printers that change the frequency of ink ejection to vary the quantity of ink in each pixel and printers that vary the quantity of ink per ejection. Such multivalued printers ensure the smooth tone expression and improve the image quality.

In the ink ejection-type printers, the image quality of the resulting printed image is affected by the printing paper. This is because the state of penetration of ejected ink depends upon the printing paper. For example, in the case of plain paper, ink readily penetrates into the sheet. The plain paper is not able to sufficiently hold the ink dye in the vicinity of the sheet surface and may thus not ensure the desired density expression. In order to compensate for this potential disadvantage, the prior art technique increases the quantity of ink ejection than usual in the case of printing in a printing medium of high ink permeability, for example, the plain paper. A concrete procedure changes the contents of the halftone processing to enhance the dot recording density when such a printing medium is selected.

The prior art multivalued printer has a relatively restricted density range expressible in each pixel. The structure using a large number of different inks having different densities to express a greater number of tones disadvantageously expands the size of the print head. The printing medium generally has an upper limit in quantity of ink absorbable per unit area (hereinafter referred to as the duty restriction). The variation in quantity of ink ejected in each pixel is accordingly restricted to the upper limit. The printing medium having high ink permeability, for example, the plain paper, has a relatively low duty restriction. The prior art printing apparatus does not attain the sufficient density expression nor ensure the sufficient image quality in such printing media.

The arrangement of creating dots with the varying quantity of ink also has the restrictions by the printing speed and the print head mechanism. Under the condition of a fixed driving frequency of the print head, the printing speed is lowered with an increase in frequency of ejection per pixel. The allowable range of varying the quantity of ink ejected from each nozzle has upper and lower limits according to the nozzle diameter. With a recent trend of high printing resolution that requires very fine dots, the allowable range of varying the quantity of ink is more strictly restricted.

In the prior art technique, the area of high density is expressed by raising the dot recording density or by increasing the quantity of ink ejected in each pixel. This increases the quantity of ink ejected per unit area and may cause stains or blots.

Because of these factors discussed above, the prior art technique has a relatively restricted range of tones expressible in each pixel.

DISCLOSURE OF THE INVENTION

One object of the present invention is to extend a range of tone values expressible in each pixel and thereby improve the image quality in a printing apparatus that ejects ink to print an image. Another object of the present invention is to provide a print head that attains such a wide tone range and a method of driving the print head. Still another object of the present invention is to ensure adequate tone expression in the case of printing in a printing medium having a high penetration rate of ink.

At least part of the above and the other related objects is attained by a print head that pressurizes ink in an ink conduit, through which a supply of ink is fed from an ink tank to a nozzle, so as to cause ink to be ejected from the nozzle and create a dot.

The print head includes: a pressure variation unit that varies a pressure applied to the ink in the ink conduit; and a driving unit that controls the pressure variation unit to apply the pressure to the ink along a preset pressure waveform.

In this print head, the driving unit varies a parameter relating to a pressure reduction, so as to enable different dots to be created in different dot creation states with a substantially identical quantity of ink.

In the print head of the present invention, the driving unit varies the parameter relating to the pressure reduction, so as to enable different dots to be created in different dot creation states with a substantially identical quantity of ink.

In the print head of this configuration, varying the waveform of the pressure applied o the ink enables different dots to be created in a variety of dot creation states with a substantially identical quantity of ink. Under the condition of ejecting a fixed quantity of ink, the different dot creation states vary the density expressed. The print head of the present invention accordingly varies the density expressed in one pixel under the condition of a substantially identical quantity of ink. Printing with the print head of the present invention ensures the richer tone expression and thereby improves the image quality. This arrangement extends the expressible tone range without increasing the quantity of ink, thus reducing the occurrence of blots or stains.

The relationship between the dot creation state and the expressed density is described below. The dot creation state represents the shape of dots actually created on the printing medium when a substantially identical quantity of ink is ejected. Ejection of ink at one point in a concentrated manner and ejection of ink in a predetermined area in a diffused manner result in creating dots of different forms. The substantially identical quantity of ink does not require strict constancy in the plural dot creation states, but may be in a range that can be regarded as constant based on the quantity of ink absorbable by the printing medium. It is conventionally thought that different dot creation states express an identical density as a whole in the case of a fixed quantity of ink ejection.

As results of minute analyses, the inventors of the present invention have, however, found that different dot creation states vary the total area of dots. The variation in total area of dots naturally varies the density expressed as a whole.

The principle of varying the area according to the dot creation state is described with the comparison between the case of creating a single dot and the case of creating a split dot. FIG. 1 shows a dot created by ejecting ink at one point in a concentrate manner. The upper row of the drawing shows a moment when an ink droplet Ip hits against a printing medium P. The ink droplet Ip penetrates in the direction of the depth of the printing medium P at a velocity Vy and in the direction of the plane at a velocity Vx. The penetration results in creating a single dot Dt having a diameter d as shown in the lower row of the drawing. The ejected ink droplet penetrates into the printing medium to have a sectional shape defined by the hatched area in the drawing.

FIG. 2 shows dots created by ejecting ink in a splitting manner as two ink droplets Ip1 and Ip2. The upper row of the drawing shows a moment when the ink droplets Ip1 and Ip2 hit against the printing medium P. In this example, the ejected ink is split into the ink droplets Ip1 and Ip2 of an identical size. The total quantity of the ink droplets Ip1 and Ip2 is identical with the quantity of the ink droplet Ip in the example of FIG. 1.

When ink is ejected in a splitting manner, the respective ink droplets Ip1 and Ip2 penetrate in the direction of the depth of the printing medium P at the velocity Vy and in the direction of the plane at the velocity Vx as in the case of FIG. 1. The penetration results in creating dots Dt1 and Dt2 having a diameter d1 as shown in the lower row of FIG. 2. Each ejected ink droplet penetrates into the printing medium to have a sectional shape defined by the hatched area in the drawing. The diameter d1 is smaller than the diameter d.

The penetration speed of the ink droplet Ip1 (FIG. 2) into the printing medium P is equivalent to that of the ink droplet Ip (FIG. 1). Namely the ink droplets penetrating in the printing medium have similar shapes (the hatched areas in FIGS. 1 and 2). As mentioned above, the volume of the ink droplet Ip1 is half the volume of the ink droplet Ip. The similarity ratio of the dot Dt1 to dot Dt, that is, the ratio of the diameter d1 to the diameter d, is given as a cube root of the volume ratio. In this example, the volume of the dot Dt1 is 0.5 times as large as the volume of the dot Dt, so that the relationship between the diameter d1 and the diameter d is defined by Equation (1) given below:

$$D1=0.5^{(1/3)}\times d \quad (1)$$

The areas of the resulting dots Dt and Dt1 are respectively proportional to the square of the diameters d and dt1. The relationship between area of the dot Dt1 and the area of the dot Dt is accordingly defined by Equation (2) given below:

$$Dt1=0.5^{(2/3)}\times Dt \quad (2)$$

In the example of FIG. 2, two dots of the same area are created. The total area of the dots created in the example of FIG. 2 is accordingly given by:

$$Dt1+Dt2=2\times 0.5^{(2/3)}\times Dt\approx 1.26Dt$$

Namely the method of splitting the dot into two divisions enhances the resulting expressed density to approximately 1.26 times. The above description regards the case of splitting the dot into two divisions. Splitting into a greater number of divisions further enhances the resulting expressed density. When A1 and An respectively denote the area of a single dot and the area of each dot division by splitting a dot into n divisions, their relationship is defined by Equation (3) given below, based on the same principles as those of Equations (1) and (2) discussed above:

$$An=(1/n)^{(2/3)}\times A1 \quad (3)$$

FIG. 3 is a graph showing the relationship between the number of dot divisions and the total dot area. The total dot area is calculated according to Equation (3) by changing the number of splits from 1 to 4. As clearly understood from the graph, the total dot area by a fixed quantity of ink increases with an increase in number of splits. Since it is thought that the resulting expressed density is substantially proportional to the dot area, the resulting expressed density is heightened with an increase in number of splits.

For example, when a single dot is created with a quantity of ink q1, the total dot area is equal to Ar1 in the graph. When a split dot having two divisions is created with the quantity of ink q1, on the other hand, the total dot area is equal to Ar2 in the graph. This is equivalent to the density when a single dot is created with a greater quantity of ink q2. The quantity of ink q2 is approximately 1.4 times as large as the quantity of ink q1. The method of splitting a dot into a plurality of divisions readily enhances the resulting expressed density to the level attained by significantly increasing the quantity of ink.

The above description is on the assumption that the dot is completely split into two divisions. The two dots may alternatively be created in a partly overlapping manner. Namely the dot may not be split but may be deformed in shape. In such cases, the size of the overlapped portion determines the total dot area and the resulting expressed density.

As described above, the print head of the present invention enables dots to be created in a variety of dot creation states. It is preferable that the different dot creation states have different numbers of dot divisions. As shown in the graph of FIG. 3, varying the number of dot divisions ensures a significant difference in resulting effects. The number of dot divisions may be set arbitrarily. It is, however, desirable to create a nonsplit dot and a split dot having two divisions since these dots are created most stably.

Since it is conventionally thought that a fixed quantity of ink ejection gives the same resulting expressed density, no techniques have been proposed to change the dot creation state. It is known in the art that splash of ink at the time of ink ejection sometimes forms very small dots called satellites in the vicinity of a target dot to be created. No studies have, however, been performed to examine the effects of the satellites on the resulting density. The occurrence of satellites is generally regarded as undesirable, and no prior art techniques have tried to change the dot creation state by positively forming satellites.

The technique of the present invention changes the parameter relating to the pressure reduction, so as to control the dot creation state. The print head of the present invention ejects ink by varying the pressure applied to the ink in the ink conduit. The ink is ejected under a high pressure of or above a preset level. Based on the results of detailed experiments, the inventors of the present invention have found that the arrangement of setting a pressure reducing period at least one of before and after a pressure raising period and varying the pressure reducing conditions effectively changes the dot creation state without requiring a variation in quantity of ink.

The relationship between the pressure waveform and the dot creation state is described here in the case where the preset pressure waveform includes a high pressure section to apply a high pressure to the ink and a subsequent reducing pressure section to subsequently reduce the pressure.

In this case, any of the following factors may be applied for the parameter relating to the pressure reduction:

The first parameter is a timing of starting the pressure reduction.

The second parameter is a quantity of pressure reduction.

The third parameter is a rate of change in pressure reduction.

The following describes the change of the dot creation state by varying the pressure waveform with regard to the various parameters. FIG. 4 shows ejection of an ink droplet in response to a driving waveform applied to the print head. In this illustrated example, the waveform to drive the print head first lowers the pressure in a division d1, raises the pressure in a division d2, and lowers the pressure in a division d4 again after the elapse of a division d3. The divisions d2 through d4 correspond to the 'waveform applying a high pressure to the ink and subsequently reducing the pressure' discussed above.

The waveform of FIG. 4 represents a standard state without varying any of the first through the third parameters defined above. States 'a' through 'c' show the behavoir of ink when the print head is actuated in response to the standard waveform. The states 'a' through 'c' are enlarged sectional views of the nozzle Nz formed in the print head. When the pressure is reduced in the division d1, the interface of ink or meniscus is concaved inward due to the pressure variation as shown in the state 'a'.

When the pressure is raised in the subsequent division d2, the raised pressure causes an ink droplet Ip to be ejected as shown in the state 'b'. The ink droplet Ip is ejected from the substantial center of the meniscus Me, which is kept in the concaved state. When the pressure is reduced again in the division d4, the vibration arising at the meniscus at the moment of ink ejection is damped and the meniscus is returned to the original state prior to the ejection. The ejected ink droplet Ip flies to hit against the printing medium to create a dot DL.

FIG. 5 shows a variation in pressure waveform with a change of the first parameter. The first parameter is the timing of pressure reduction. The change of the parameter is equivalent to the change of the time period prior to the pressure reduction after application of a high pressure, from a period d3*a* to a period d3*c* in the illustrated example. The pressure waveform varies in three steps expressed as waveform segments L3*a*, L3*b*, and L3*c* in the order of the timing. These waveform segments have an identical quantity of pressure reduction and an identical rate of change.

FIG. 6 shows the state of an ink droplet when the pressure is reduced at the earliest timing. This corresponds to the waveform segment L3*a* in FIG. 5. As the pressure decreases, the force is applied to the meniscus Me to draw the meniscus Me inward the nozzle Nz. The meniscus Me accordingly has a velocity component Vme drawn inward the nozzle. The velocity component Vme arising at the meniscus Me has the function of separating an ejected ink droplet Ip in an area Ir in the vicinity of the boundary. In the case where the pressure is reduced before the ink droplet Ip is completely separated from the meniscus Me, the surface tension of ink causes the ink droplet Ip to be affected by the velocity component Vme arising at the meniscus Me. The ink droplet Ip accordingly has a local speed difference. A front division Ipf of the ejected ink droplet flies at a relatively high speed, whereas a rear division Ipb of the ink droplet has a lower flight speed. The right side of FIG. 6 shows resulting dots thus created. When the meniscus Me is drawn inward the nozzle at a relatively early timing, the resulting dot is split into divisions as illustrated.

FIG. 7 shows the state of an ink droplet when the pressure is reduced at the intermediate timing. This corresponds to the waveform segment L3*b* in FIG. 5. Delaying the timing changes the state of separation of the ink droplet from the meniscus and the local speed difference of the ink droplet. In the case of the delayed timing, the meniscus Me is drawn inward the nozzle when the ink droplet Ip is further away the nozzle. There is accordingly a relatively small area having a locally reduced speed. Namely the rear division Ipb of the ink droplet has a small volume. As shown on the right side of FIG. 7, a small dot is created adjacent to a relatively large dot in this case.

FIG. 8 shows the state of an ink droplet when the pressure is reduced at the slowest timing. This corresponds to the waveform segment L3*c* in FIG. 5. Further delaying the timing causes the meniscus Me to be drawn inward the nozzle when the ink droplet Ip has almost been separated from the meniscus Me. The drawing action of the meniscus Me thus hardly affects the behavoir of the ink droplet Ip. As shown on the right side of FIG. 8, a single dot is accordingly created. Changing the timing of drawing the meniscus Me inward as discussed above enables creation of the split dot and adjustment of the size and the flight speed of the rear division of the split dot.

FIG. 9 is a graph showing the results of experiments varying the first parameter. Variations in flight speeds and areas of the respective divisions of the dot ejected in a splitting manner are plotted against the first parameter, that is, the time period d3 prior to the start of speed reduction, on the abscissa. The symbols Vf, Vb, Ipf, and Ipb have the same meanings as those of FIGS. 6 through 8. As shown in the graph, as the parameter d3 increases, the front division of the split dot has the increasing volume Ipf while keeping the flight speed Vf substantially constant. The rear division of the split dot, on the other hand, has the increasing flight speed Vb but the decreasing volume Ipb. When the parameter d3 exceeds a certain threshold value, the ink droplet is not split but forms a single dot. Areas F6, F7, and F8 shown in the graph respectively correspond to the states of FIGS. 6 through 8 discussed above.

The following describes the effects of the second parameter. FIG. 10 shows a variation in pressure waveform with a change of the second parameter. The second parameter is the quantity of pressure reduction. In this example, the quantity of pressure reduction after application of a high pressure is varied in three different stages. The quantity of pressure reduction increases in the order of waveforms L4*a*, L4*b*, and L4*c*. The waveforms L4*b* and L4*c* reduce the pressure to the lower levels than the reference pressure before the ink ejection. In such cases, after the ejection of an ink droplet is concluded, the pressure of the ink is returned to the reference level at a specific rate that does not cause ink to be ejected from the nozzle.

FIG. 11 shows the state of an ink droplet under the condition of a smallest quantity of pressure reduction. This corresponds to the waveform L4*a* in FIG. 10. FIG. 12 shows the state of an ink droplet under the condition of an intermediate quantity of pressure reduction. This corresponds to the waveform L4*b* in FIG. 10. FIG. 13 shows the state of an ink droplet under the condition of a largest quantity of pressure reduction. This corresponds to the waveform L4*c* in FIG. 10.

The effects of the inwardly drawn meniscus Me are described previously with FIGS. 5 through 8. The variation in quantity of pressure reduction changes the drawing depth of the meniscus Me. This varies the velocity of the part of the ink droplet affected by the inwardly drawn meniscus Me. The greater drawing depth of the meniscus Me results in the lower velocity of the rear division Ipb of the split dot as clearly understood from FIGS. 11 through 13. As shown in FIGS. 11 through 13, the increase in drawing depth of the meniscus Me enhances the velocity component Vme of the rear division of the ink droplet (that is, the left division of the split dot in the drawing) drawn inward the nozzle, but lowers the velocity of the rear division of the ink droplet after the separation of the ink droplet from the meniscus Me. As shown on the right side of FIGS. 11 through 13, this extends the interval between the divisions of the split dot. Although FIGS. 11 through 13 show the split dots clearly divided into two parts, the two divisions of the split dot may be overlapped.

FIG. 14 is a graph showing the results of experiments varying the first parameter. Variations in flight speeds and areas of the respective divisions of the dot ejected in a splitting manner are plotted against the second parameter, that is, the quantity of pressure reduction, on the abscissa. As shown in the graph, as the quantity of pressure reduction increases, the front division of the split dot has the increasing volume Ipf while keeping the flight speed Vf substantially constant. The rear division of the split dot, on the other hand, has both the decreasing flight speed Vb and the decreasing volume Ipb. Areas F11, F12, and F13 shown in the graph respectively correspond to the states of FIGS. 11 through 13 discussed above.

The following describes the effects of the third parameter. FIG. 15 shows a variation in pressure waveform with a change of the third parameter. The third parameter is a rate of change in pressure reduction. Here the rate of change denotes the quantity of reduction per unit time. In this example, the rate of change in pressure reduction after application of a high pressure is varied in three different stages. The rate of change in pressure reduction decreases in the order of waveforms L4*d*, L4*e*, and L4*f*.

FIG. 16 shows the state of an ink droplet under the condition of a largest rate of change in pressure reduction. This corresponds to the waveform L4*d* in FIG. 15. FIG. 17 shows the state of an ink droplet under the condition of an intermediate rate of change in pressure reduction. This corresponds to the waveform L4*e* in FIG. 15. FIG. 18 shows the state of an ink droplet under the condition of a largest rate of change in pressure reduction. This corresponds to the waveform L4*f* in FIG. 17.

The rate of change in pressure reduction affects the drawing velocity of the meniscus Me. The smaller rate of change in pressure reduction results in the lower drawing velocity Vme of the meniscus Me as clearly understood from FIGS. 16 through 18. The ejected ink droplet Ip accordingly has a smaller local speed difference. As shown in FIGS. 16 through 18, the smaller local speed difference causes the front division Ipf and the rear division Ipb of the ink droplet to have the closer hitting positions on the printing medium. Although FIG. 18 schematically shows two dots formed close to each other in a partly overlapping manner, one elliptical dot having a major axis from left to right is actually formed by the effect of blotting. In the specification hereof, a deformed dot due to a local speed difference of the ink droplet is regarded as one state of 'division'.

FIG. 19 is a graph showing the results of experiments varying the third parameter. Variations in flight speeds and areas of the respective divisions of the dot ejected in a splitting manner are plotted against the third parameter, that is, the rate of change in pressure reduction, on the abscissa. As shown in the graph, as the rate of change in pressure reduction increases, that is, as the pressure is abruptly reduced, the front division of the split dot keeps both the flight speed Vf and the volume Ipf substantially constant. The rear division of the split dot, on the other hand, has the decreasing flight speed Vb while keeping the volume Ipb substantially constant. Areas F16, F17, and F18 shown in the graph respectively correspond to the states of FIGS. 16 through 18 discussed above.

As described above, the dot creation state is adjusted to create, for example, a non-split dot, a split-dot, or a deformed dot by varying any of the parameters relating to the pressure reduction after the ejection of the ink droplet Ip. Varying the parameters also regulates the interval between the divisions of the split dot and the volumes of the front division and the rear division of the split dot. Each of the parameters discussed above may be varied while the pressure relating to the ejection of the ink droplet (that is, the division d2 in FIG. 4) is kept constant. The dot creation state is thus changed appropriately under the condition of a fixed quantity of ink by varying each of the parameters discussed above.

With the reference waveform shown in FIG. 4, the following describes the case where the preset pressure waveform includes a high pressure section to apply a high pressure to the ink and a pre-reducing pressure section to reduce the pressure prior to the high pressure section, and the parameter is a quantity of pressure reduction in the pre-reducing pressure section.

The divisions d1 to d2 in FIG. 4 correspond to the 'waveform of reducing the pressure prior to application of a high pressure to the ink'. FIG. 20 shows a variation in pressure waveform with a change of the quantity of pressure reduction in the division d1. This example shows two waveforms respectively corresponding to a small quantity of pressure reduction (waveform L1*a*) and a large quantity of pressure reduction (waveform L1*b*). With regard to the pressure at the time of ink ejection (corresponding to the division d2 in FIG. 4), the waveforms L1*a* and L1*b* may have an identical peak pressure or an identical pressure difference. In the case of the identical peak pressure, the waveforms L1*a* and L1*b* commonly follow a waveform segment L2*a* shown in FIG. 20. In the case of the identical pressure difference, on the other hand, the waveform L1*a* follows the waveform segment L2*a* whereas the waveform L1*b* follows another waveform segment L2*b*.

FIG. 21 shows the state of the meniscus Me according to the variation in quantity of pressure reduction. The left-side drawing shows the state corresponding to the small quantity of pressure reduction (the waveform L1*a* in FIG. 20). The right-side drawing shows the state corresponding to the large quantity of pressure reduction (the waveform L1*b* 9 in FIG. 20). In the case of the small quantity of pressure reduction, the meniscus Me is concaved inward the nozzle Nz in response to the pressure reduction as shown by the left-side drawing.

As the quantity of pressure reduction increases, the meniscus Me is concaved to a greater depth and has a rise S on the substantial center thereof as shown by the right-side drawing. The cause of this phenomenon has not been elucidated clearly. But it is assumed that abruptly drawing the meniscus inward the nozzle destroys the balance of the surface tension of the meniscus and a vibration arises to invert the substantial center of the meniscus having the smallest in surface tension. The occurrence of the rise S affects the velocity of the ejected ink droplet.

FIG. 22 shows the state of an ink droplet in the case of the small quantity of pressure reduction. This corresponds to the waveform L1*a* in FIG. 20. FIG. 23 shows the state of an ink droplet in the case of the large quantity of pressure reduction. This corresponds to the waveform L1*b* in FIG. 20. As described previously, varying the quantity of pressure reduction changes the velocity of the meniscus Me immediately before the ink ejection. The case of the large quantity of pressure reduction (the right-side drawing of FIG. 21) has a higher velocity component on the substantial center of the meniscus in the direction of ejection (that is, the direction Dir in FIG. 21), so that the ink droplet is ejected at a higher velocity. As clearly understood from FIGS. 22 and 23, varying the quantity of pressure reduction thus regulates the velocity of the front division Ipf of the ink droplet and the interval between the respective divisions of the split dot.

FIG. 24 is a graph showing the results of experiments when the quantity of speed reduction is changed while the peak pressure is kept constant. Variations in flight speeds of the respective divisions of the dot ejected in a splitting manner are plotted against the quantity of pressure reduction on the abscissa. As shown in the graph, under the condition of small quantities of pressure reduction, the ink droplet is not split but forms a single dot. When the quantity of pressure reduction exceeds a predetermined threshold value, the ink droplet is split into a front division and a rear division. With an increase in quantity of pressure reduction, there is a greater speed difference between the front division and the rear division of the split dot. Areas F22 and F23 shown in the graph respectively correspond to the states of FIGS. 22 and 23 discussed above.

As described above, the dot creation state is varied by generating the waveform that includes a pressure reducing section at least either before or after the ink ejection and regulating the pressure reduction. The waveform may include the pressure reducing sections both before and after the ink ejection.

The pressure reduction may be varied in a continuous manner, instead of in the stepwise manner as in the above description. Appropriate values are set to the respective parameters according to the nozzle diameter and the viscosity of ink, in order to attain a desirable dot creation state for printing. The above description regards the primary effects of the respective parameters on the dot creation state. In the actual conditions, the respective parameters closely affect one another.

In accordance with one preferable application of the print head of the present invention, the pressure variation unit changes a cross section of the ink conduit, so as to vary the pressure applied to the ink.

It is especially preferable that the pressure variation unit includes an electrostrictive element that is disposed adjacent to the ink conduit to generate a predetermined strain in response to an applied voltage, and that the driving unit regulates the voltage applied to the electrostrictive element to vary the pressure. A piezoelectric element may be applied for the electrostrictive element.

Such application for the pressure variation unit ensures a variation in ink pressure with a high response, thus enabling the print head to be driven at a high frequency. The print head of this application ensures printing of the high image quality, while keeping the high printing speed.

The print head having any of the above configurations may create a plurality of different dots having different quantities of ink. For example, in a print head that changes the quantity of ink ejected per pixel between a high level and a low level, dots may be created in the plurality of dot creation states discussed above with regard to only one of the two different levels of ink quantity or with regard to both the two different levels of ink quantity.

The present invention is also directed to a printing apparatus that ejects ink and creates a dot in each pixel on a printing medium, so as to print a multi-tone image.

The printing apparatus includes: an input unit that inputs halftone-processed print data; and a dot creation unit that selectively uses one of a plurality of preset different dots according to the input print data and creates the selected dot in each pixel.

The plurality of preset different dots include at least two different dots corresponding to a plurality of dot creation states having different areas with a substantially equivalent quantity of ink.

The printing apparatus of this arrangement enables creation of dots in the plurality of dot creation states having different areas. As described previously, the resulting expressed density depends upon the dot area. The printing apparatus of the present invention accordingly enables a plurality of different densities to be expressed with regard to each pixel, thus ensuring the smooth tone expression and improving the image quality of printing. These effects are especially prominent in the low tone area.

The technique of varying the quantity of ink ejected in each pixel is the only proposed technique as the prior art to express a plurality of different densities with a fixed quantity of ink. All the other proposed techniques mentioned above, for example, the technique of varying the frequency of ink ejection in each pixel and the technique of varying the quantity of ink per ejection, express the multiple densities by varying the total quantity of ink ejected in each pixel.

As discussed above, however, the resulting expressed density may be varied by changing the dot creation state under the condition of a substantially identical quantity of ink. The printing apparatus of the present invention is based on this principle to attain the smooth tone expression. This arrangement is free from the disadvantages of a large-sized print head provided with a large number of different inks having different densities, although the present invention does not exclude the structure using inks of different densities. The application of creating dots in a plurality of dot creation states as described previously with inks of different densities attains smoother tone expression.

The printing apparatus of the present invention can vary the dot area without changing the quantity of ink ejected in each pixel. This arrangement thus varies the expressible tone value in each pixel, regardless of the restriction of the absorbable quantity of ink per unit area of the printing medium (hereinafter referred to as the duty restriction). This arrangement ensures the smooth tone expression even in printing media of low duty restriction.

In accordance with a first configuration of the printing apparatus of the present invention, the print head is applied for the dot creation unit described above.

In accordance with a second configuration, the dot creation unit has: an ink ejection unit that is capable of varying a quantity of ink per ejection; and a driving unit that controls the ink ejection unit to change a quantity, a frequency, and a position of ink ejection and thereby ensure creation of dots in the plurality of dot creation states.

For example, in the case of creating a split dot having two divisions as shown in FIG. 2, this application halves the quantity of ink per ejection and ejects ink twice at different positions. The printing apparatus generally carries out printing while moving the print head back and forth relative to the printing medium (hereinafter referred to as the main scan). In this structure, ejection of ink at two different times having a predetermined time interval enables two dots to be created at different positions. The two dots may be created by one pass of the main scan or by two different passes of the main scan. The above description regards the case of creating a split dot having two divisions, but the same principle is applied to create a split dot having a greater number of divisions.

The second structure has an advantage of stably creating a split dot. A variety of mechanisms have been proposed to vary the quantity of ink per ejection. For example, in a print head based on the mechanism of supplying electricity to heaters disposed in the nozzles and ejecting ink by means of the pressure of bubbles produced in the ink, the quantity of ink per ejection is varied by regulating the number of heaters and the quantity of power supply. In another print head based on the mechanism of ejecting ink by means of the strain arising in the process of application of a voltage to piezoelectric elements, the quantity of ink per ejection is varied by changing the waveform of the voltage applied. The technique of the present invention is not restricted to these print heads but is applicable to a variety of other print heads that are capable of varying the quantity of ink.

It is preferable that the printing apparatus described above enables expression of three or more density values. Each tone value after the halftone processing to the three or more density values corresponds to the evaluation value of the density expressed by each dot in each pixel. The halftone processing is not necessarily performed in the printing apparatus, but the printing apparatus may receives the halftone-processed data and carry out printing. The printing apparatus may alternatively process the multi-tone image data by halftone processing and then carry out printing. A variety of methods, such as the error diffusion method and the dither method, are applicable for the halftone processing.

The present invention is further directed to a printing apparatus that creates dots on a printing medium, so as to print a multi-tone image.

The printing apparatus includes: an input unit that inputs print data halftone-processed to a preset number of tone values; a dot creation state changing unit that changes over a dot creation state among different dot creation states having different densities expressed with a substantially identical quantity of ink; a printing medium input unit that inputs a type of a printing medium; a storage unit that stores a mapping of each tone value of the print data to each of the different dot creation states with regard to each printing medium; and a control unit that controls the dot creation state changing unit based on the mappings stored in the storage unit and enables dots to be created in a selected dot creation state according to the input type of the printing medium.

The printing apparatus of this arrangement enables creation of dots in a dot creation state suitable for the type of the printing medium. Different printing media generally have different penetration characteristics in the course of ink ejection and accordingly have different resulting densities expressed with dots created by ejecting a fixed quantity of ink. The printing apparatus of the above configuration changes the dot creation state corresponding to the printing medium and thereby compensates for a density difference due to the different ink penetration characteristics of the printing media. This arrangement ensures the appropriate tone expression suitable for each printing medium.

The effects of the improved image quality are especially prominent in printing media of low duty restriction. The printing media of low duty restriction generally have a high ink penetration speed. The ejected ink thus quickly penetrates in the direction of the depth of the printing medium, and the dye of the ink is not sufficiently held in the vicinity of the surface to ensure the sufficient density expression. The low duty restriction also makes it impossible to increase the quantity of ink to allow the sufficient density expression. The printing apparatus of the present invention changes the dot creation state to enhance the expressible density without increasing the quantity of ink. This arrangement enables the sufficient tone expression even in printing media of the low duty restriction and accordingly improves the image quality.

As described previously with FIG. 25, the resulting expressed density varies with a variation in number of divisions of the split dot under the condition of a fixed quantity of ink. FIG. 18 shows the comparison on the same printing medium. The dot creation state on the printing medium having the high ink permeability is compared with the dot creation state on the printing medium having the restricted ink permeability. When a fixed quantity of ink is ejected, the dot created on the former printing medium has a greater area than that of the dot created on the latter printing medium. The ink, however, penetrates in the direction of the depth of the former printing medium, so that the former dot has a lower expressed density than that of the latter dot. Namely the relationship between the dot area and the resulting expressed density depends upon the printing medium.

The graph of FIG. 25 shows that the split dot has a higher expressed density than the single dot on the same printing medium. Under the condition of a fixed quantity of ink ejection, the technique creates the split dot on the printing medium of the high ink permeability and the single dot on the printing medium of the restricted ink permeability. This arrangement reduces the difference in density expression between these printing media. The printing apparatus of the present invention attains the appropriate tone expression with regard to each printing medium, based on this principle.

The printing apparatus of the present invention is characterized by the relationship between the print data and the dot to be created that is different from that of the prior art technique. The prior art printing apparatus typically has a fixed relationship between the print data and the dot to be created, regardless of the type of the printing medium. For example, in the case of the printing apparatus that is capable of binary density expression, that is, the dot-on and the dot-off states, in each pixel, the same dot is created according to the print data representing the dot-on state, regardless of the type of the printing medium. The printing apparatus that is capable of at least trinary density expression in each pixel follows the same principle. The prior art technique changes the dot recording density according to the type of the printing medium, so as to compensate for the density difference due to the difference in ink permeability.

The printing apparatus of the present invention, on the other hand, varies the relationship between the print data and the dot to be created according to the printing medium. The technique of the present invention creates dots in different dot creation states corresponding to different printing media with regard to the print data representing the dot-on state. In the case where the density difference due to the difference in ink permeability is sufficiently compensated by the change of the dot creation state, printing may be carried out using the common print data, irrespective of the type of the printing medium. Combination of the technique of varying the dot recording density with the technique of changing the dot creation state according to the printing medium, however, enables the density difference to be compensated more appropriately.

It is desirable that the mapping stored in the storage unit maps a dot creation state attaining expression of a higher density to a printing medium having a lower quantity of ink absorbable per unit area.

The ink readily permeates the printing medium having the low quantity of ink absorbable per unit area, that is, having the low duty restriction, in the direction of its depth. Such a printing medium accordingly tends to have the low expressed density. Setting the dot creation state to enhance the expressed density, for example, with a split dot, in this printing medium desirably reduces the difference in expressed density between the respective printing media, thus ensuring the appropriate tone expression.

The mapping of the dot creation state to the type of the printing medium is not restricted to the above description. A variety of settings are applicable to attain the appropriate tone expression by taking into account the ink permeability of each printing medium. It is not necessary that all the printing media have different dot creation states.

In the printing apparatus of the present invention, a variety of configurations may be applied for the dot creation state changing unit.

In accordance with a first configuration, the dot creation state changing unit changes a number of dot divisions from an ejected ink droplet, so as to enable dots to be created in the different dot creation states having different densities. This corresponds to the structure using the print head described previously. The number of dot divisions here includes the value '1' representing a non-split dot. A variety of methods may be applied to create a split dot according to the mechanism of the print head for ejecting ink. For example, a sub nozzle used only for creation of a split dot may be disposed adjacent to the nozzle for ejecting ink. Another method applies a vibration to the nozzle at the time of ink ejection.

It is not necessary that the divisions of the split dot are created at the same time. For example, the split dot may be created by forming two small dots in one pixel at two different times with half the quantity of ink.

In accordance with a second configuration, the dot creation state changing unit gives a local speed difference to an ink droplet ejected, so as to change the dot creation state.

This configuration may be applied to create a split dot. Ejection of an ink droplet with a local speed difference changes the shape of the ink droplet according to the degree of the speed difference and enables creation of dots in various states. In the case of a large speed difference, a split dot is created. The local speed difference is caused by varying the pressure applied to the ink in the course of ejection. For example, when the pressure is raised at the initial stage of the ink ejection and is lowered at the terminal stage, the part of the ejected ink droplet closer to the nozzle has the lower flight speed.

In accordance with a third configuration, the dot creation state changing unit varies a distance between the print head and the printing medium, so as to change the dot creation state.

The third configuration may also be applied to create a split dot. The ink droplet is deformed by the air resistance during the flight. In the case where the print head is close to the printing medium, the air resistance works only for a short time period, so as to cause a relatively small degree of deformation. With an increase in distance between the print head and the printing medium, the working time of the air resistance is lengthened to increase the degree of deformation. In some cases, the ink droplet is split into two or more divisions. The dot creation state is accordingly changed by varying the distance between the print head and the printing medium.

In accordance with a fourth configuration, when the printing apparatus includes a main scan unit that moves back and forth the print head relative to the printing medium to carry out main scan in the course of printing, the dot creation state changing unit varies a moving speed of the main scan, so as to change the dot creation state.

The fourth configuration may also be applied to create a split dot. As described above in the third configuration, the ink droplet is deformed by the air resistance during the flight. The air resistance working on the ink droplet is affected by the composite velocity of the ejecting speed of the ink droplet and the moving speed of the print head. As is generally known, the air resistance increases proportionally to the second power of the velocity. Changing the air resistance applied to the ink droplet varies the degree of deformation of the ink droplet by the air resistance. The dot creation state is accordingly changed by varying the moving speed of the print head.

The principle of the present invention is attained by a variety of applications, for example, the method of driving the print head, and the printing method, other than the applications described above. The technique of the present invention may be constructed as a program for driving the print head or the printing apparatus, a variety of signals equivalent to this program, and a recording medium in which such a program is recorded. Available examples of the recording medium include flexible disks, CD-ROMs, magneto-optic discs, IC cards, ROM cartridges, punched cards, prints with barcodes or other codes printed thereon, internal storage devices (memories like a RAM and a ROM) and external storage devices of the computer, and a variety of other computer readable media.

BEST MODES OF CARRYING OUT THE INVENTION

A. Structure of Apparatus

Figure 25:
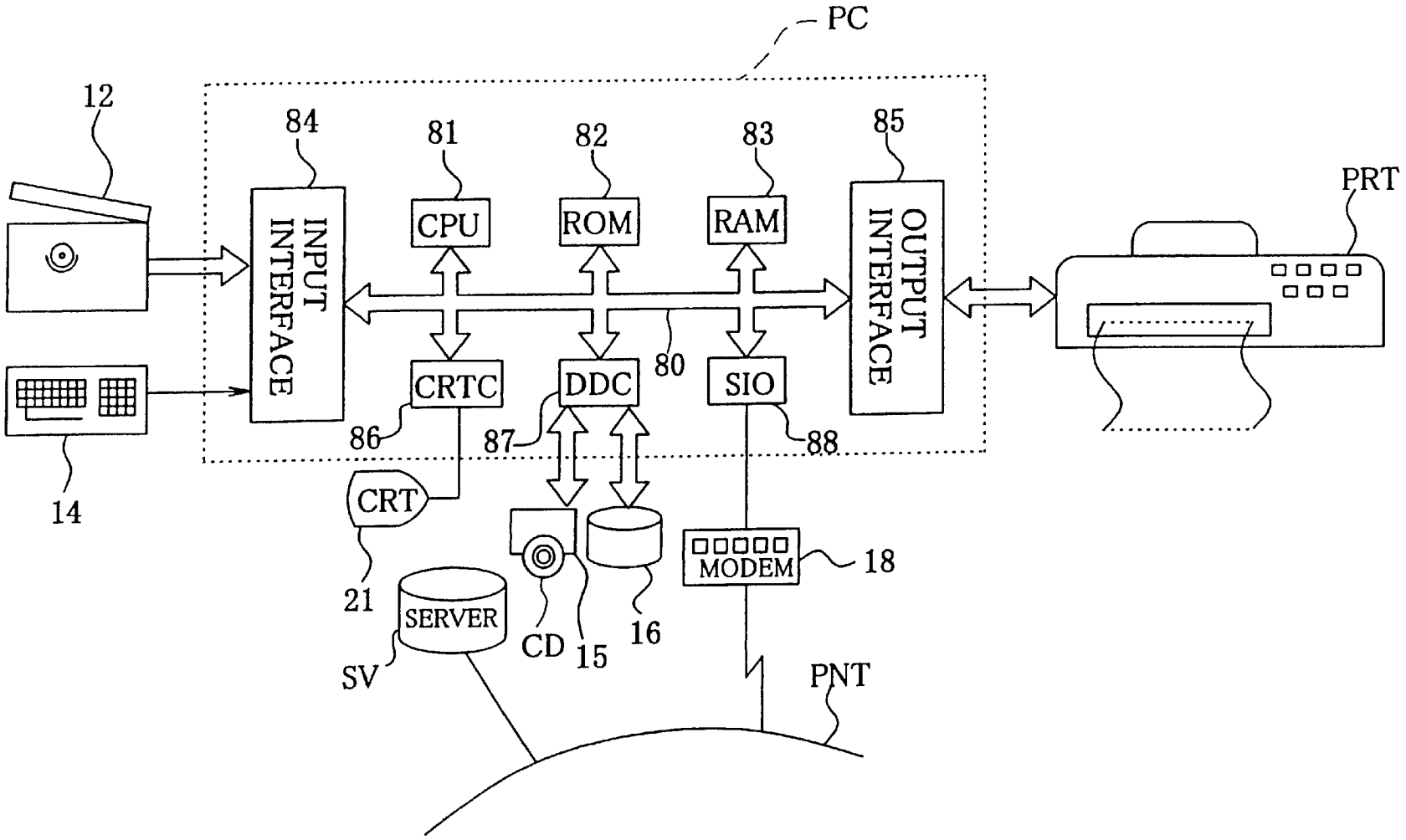
FIG. 25 is a block diagram illustrating a printing apparatus to which an image processing apparatus is applied in one embodiment of the present invention.

FIG. 25 is a block diagram illustrating a printing apparatus to which an image processing apparatus is applied in one embodiment of the present invention. As illustrated, a scanner 12 and a printer PRT are connected with a computer PC. The computer PC loads and executes a predetermined program to carry out a multi-valuing process of image data, and works in combination with the printer PRT as the printing apparatus. The printing apparatus has the function of retouching color images read from the scanner 12 in various ways and printing the retouched color images with the printer PRT.

The computer PC functioning as part of the printing a apparatus includes a CPU 81 that controls printing-related operations according to programs, a ROM 82, a RAM 83, and a variety of other constituents mutually connected via a bus 80. An input interface 84 is in charge of input of signals from the scanner 12 and a keyboard 14. An output interface 85 is in charge of output of data to the printer PRT. A CRTC 86 controls output of signals to a CRT 21 that is capable of displaying images. A disk controller (DDC) 87 controls transmission of data to and from a hard disk 16, a CD-ROM drive 16, and a non-illustrated flexible disk drive. A diversity of programs loaded to the RAM 83 and executed and programs provided in the form of device drivers are stored in the hard disk 16.

A serial input-output interface (SIO) 88 is also linked with the bus 80. The SIO 88 is connected to a modem 18 and further to a public telephone network PNT via the modem 18. The computer PC communicates with an external network via the SIO 88 and the modem 18 and gains access to a specific server SV to download programs required for printing images into the hard disk 16. The required programs may alternatively be loaded from a flexible disk FD or a CD-ROM and carried out by the computer PC. The series of the programs required for printing may be loaded as a whole, or only part of the programs may be loaded as modules.

Figure 26:
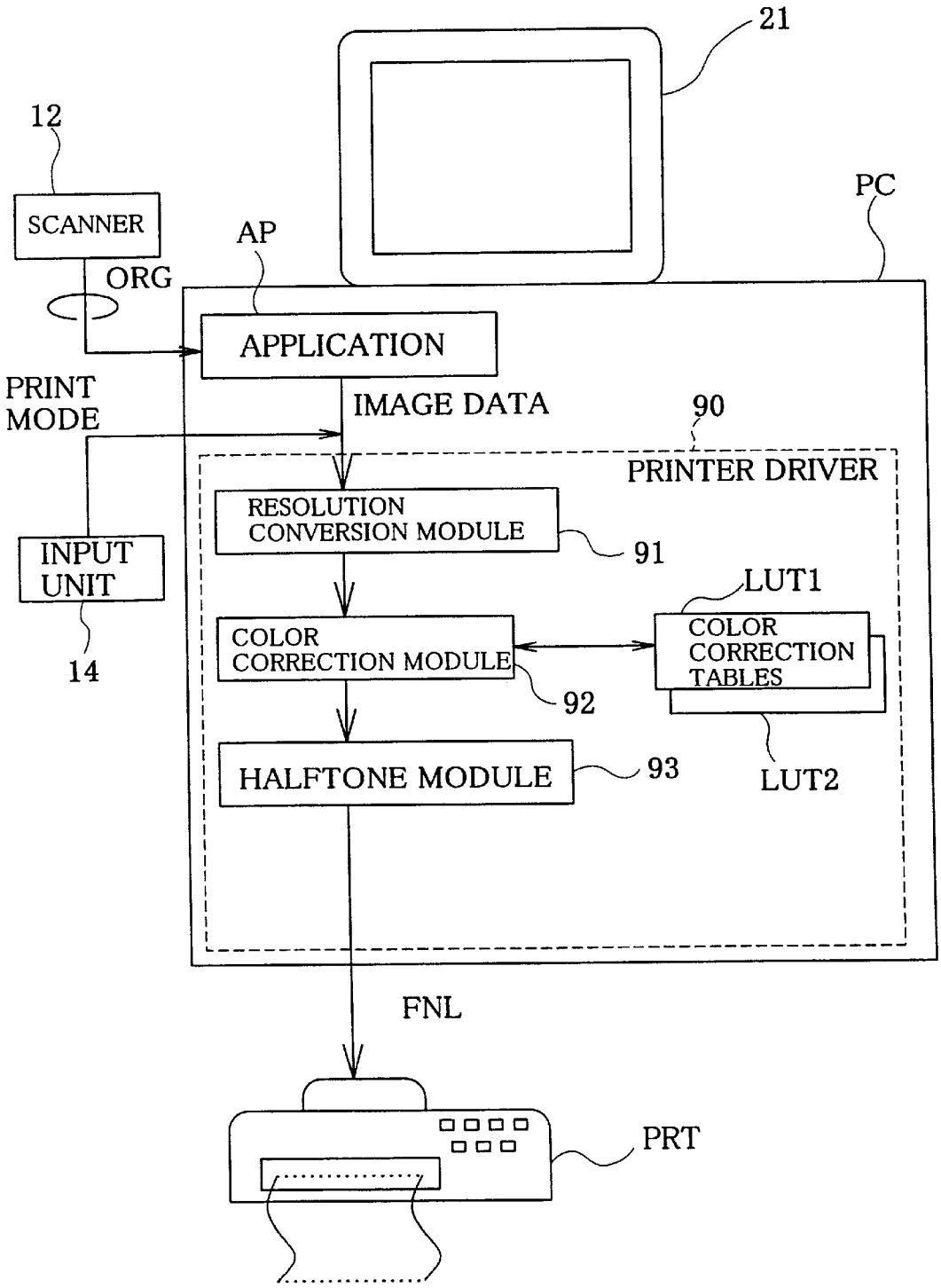
FIG. 26 shows functional blocks of the printing apparatus of the embodiment.

FIG. 26 is a block diagram illustrating the software configuration of the printing apparatus of the embodiment. In the computer PC, an application program AP is activated under the control of a predetermined operating system. A printer driver 90 is incorporated in the operating system. The application program AP reads original color image data ORG expressed by the tone values of red (R), green (G), and blue (B) from the scanner 12 and executes required processing, such as retouching of the image.

In response to a printing instruction issued by the application program AP, the printer driver 90 in the computer PC receives image data from the application program AP and converts the input image data into signals processible by the printer PRT. In the embodiment of FIG. 26, a resolution conversion module 91, a color correction module 92 and color correction tables LUT, a halftone module 93, and a rasterizer 94 are included in the printer driver 90. The printer driver 90 receives data relating to a print mode via the input unit 14, in addition to the image data. The data relating to the print mode include a printing resolution and a type of a printing medium.

The resolution conversion module 91 converts the resolution or the number of pixels per unit length of the color image data processed by the application program AP into the resolution according to printing conditions. The color correction module 92 refers to the color correction table LUT and converts the color components of the image data with regard to each pixel from the tone values of R, G, and B into the tone values corresponding to the respective inks used in the printer PRT.

As discussed later, the printer PRT uses four color inks, cyan (C), magenta (M), yellow (Y), and black (K). Color correction tables LUT1 and LUT2 specify recording rates of dots created with the respective color inks to express various colors defined by the tone values of R, G, and B. The technique of this embodiment selectively uses one of two different dot creation states according to the printing medium. Different dot creation states vary the recording rate of dots with each color ink required to express a specific color defined by the tone values of R, G, and B. The configuration of this embodiment accordingly provides two color correction tables LUT1 and LUT2 corresponding to the two different dot creation states. The color correction module 92 refers to the appropriate color correction table corresponding to the type of the printing medium and carries out the processing of color correction. In this embodiment, 8-bit data, that is, data of 256 tones, are supplied with regard to each ink.

The halftone module 93 carries out the multi-valuing process to convert the color-corrected tone values into tone values expressible by the printer PRT. The halftone module 93 specifies the dots to be created with regard to the respective inks and the respective pixels, based on the tone values of the image data. As described later, the technique of this embodiment has three different states of dot creation, that is, creation of no dot, creation of a non-split dot (hereinafter referred to as the single dot), and creation of a split dot having two divisions (hereinafter referred to as the split dot) with regard to each pixel. Namely the halftone module 93 carries out trinary conversion of each pixel data into one of three different tone values of dot creation.

The processed image data are output together with sub-scan feed data to the printer PRT as final print data FNL. The printer PRT carries out main scan and sub-scan of a print head, based on the print data FNL transferred from the printer driver 90, so as to create dots on printing paper and print an image. In the arrangement of this embodiment, the printer PRT only functions to create dots according to the print data FNL and does not carry out the image processing. In accordance with one modification, the printer PRT may carry out the image processing.

Figure 27:
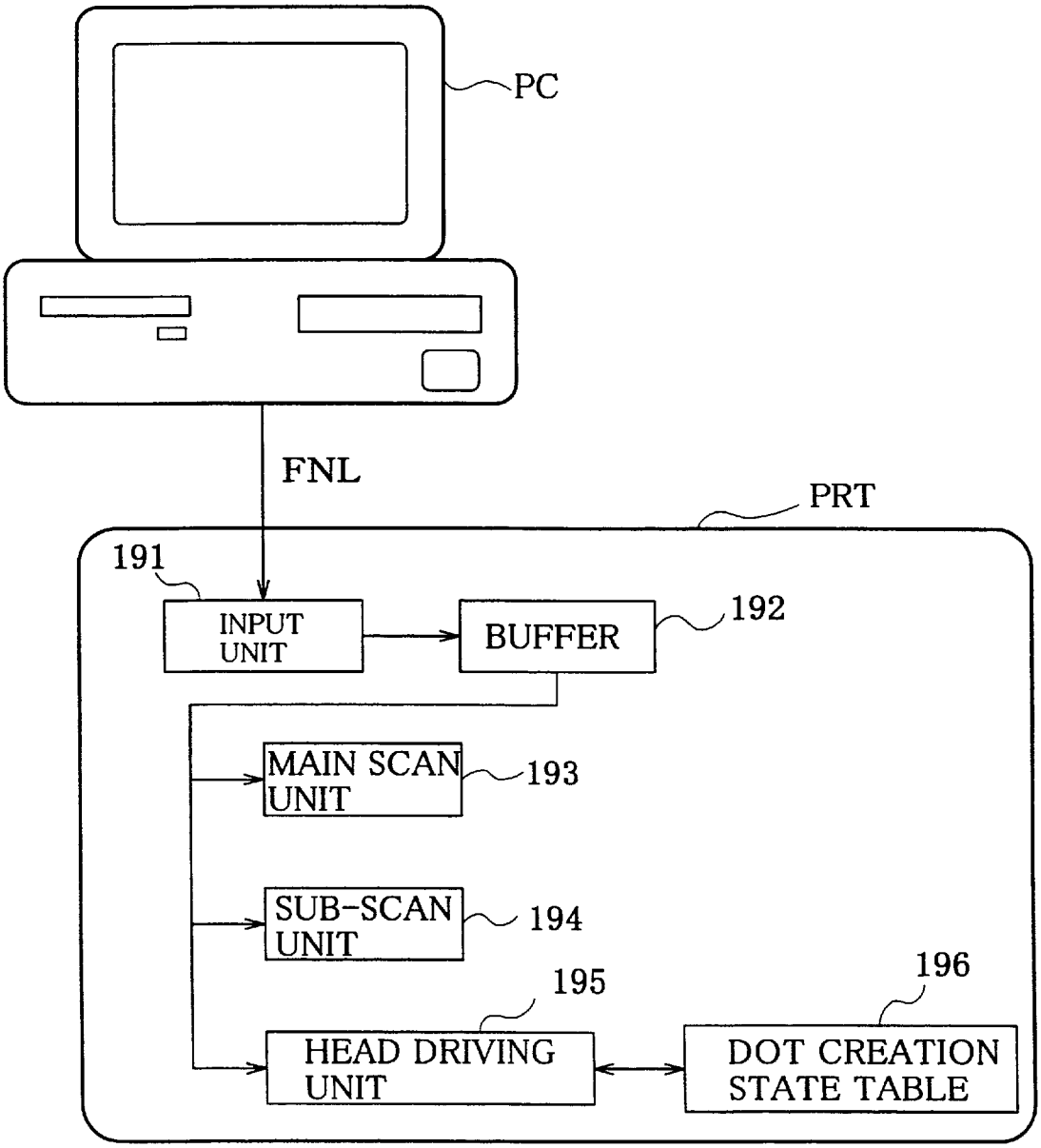
FIG. 27 shows functional blocks of a printer PRT.

FIG. 27 shows functional blocks of the printer PRT. The printer PRT includes an input unit 191, a buffer 192, a main scan unit 193, a sub-scan unit 194, and a head driving unit 195. The input unit 191 receives the print data FNL from the computer PC OD and temporarily stores the input print data FNL into the buffer 192. The print data FNL transferred from the computer PC specify the trinary tone values with regard to the respective pixels arranged in a two-dimensional manner. The main scan unit 193 carries out the main scan and shifts the print head of the printer PRT relative to printing paper, based on the print data FNL. The sub-scan unit 194 carries out the sub-scan and feeds the printing paper in a direction perpendicular to the main scanning direction on completion of every pass of the main scan.

The head driving unit 195 drives the print head of the printer PRT in each pass of the main scan, based on the print data FNL stored in the buffer 192, so as to create dots on the printing paper in the selected dot creation state corresponding to the printing medium. The mappings of the dot creation states to the printing media are stored in a dot creation state table 196. The print data FNL received by the input unit 191 include the data representing the type of the printing medium. The head driving unit 195 refers to the dot creation state table 196 and carries out dot creation in the dot creation state mapped to the specified type of the printing medium.

Figure 28:
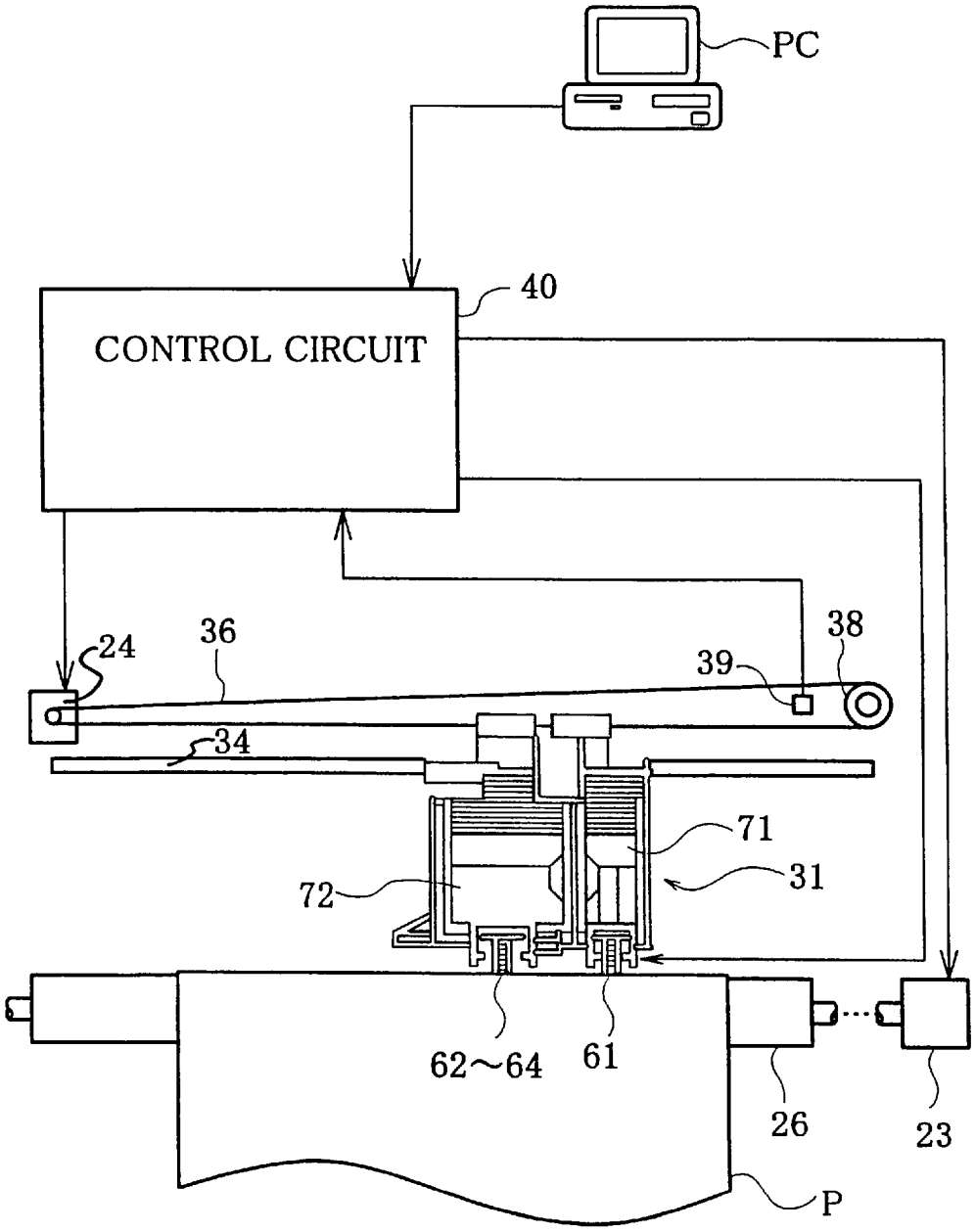
FIG. 28 schematically illustrates the structure of the printer PRT.

FIG. 28 schematically illustrates the structure of the printer with a print head mounted thereon in the embodiment. The printer moves a carriage 31 back and forth to implement the main scan, and causes inks to be ejected from print heads 61 through 64 to form raster lines on a sheet of printing paper P. After formation of raster lines, sub-scan is carried out to drive a sheet feed motor 23 and feed the sheet of printing paper P on a platen 26. The printer of the embodiment repeatedly carries out the main scan and the sub-scan to print an image according to the print data transmitted from the computer PC.

The mechanism of carrying out the main scan has the configuration discussed below. The carriage 31 is slidably held by a sliding shaft 34, which is arranged in parallel to the axis of the platen 26. The carriage 31 is moved back and forth by transmitting rotations of a carriage motor 24 via an endless drive belt 36. The drive belt 36 is spanned between the carriage motor 24 and a pulley 38. A position sensor 39 is provided to detect the position of the D3 origin of the carriage 31 and thereby control the main scan.

Figure 29:
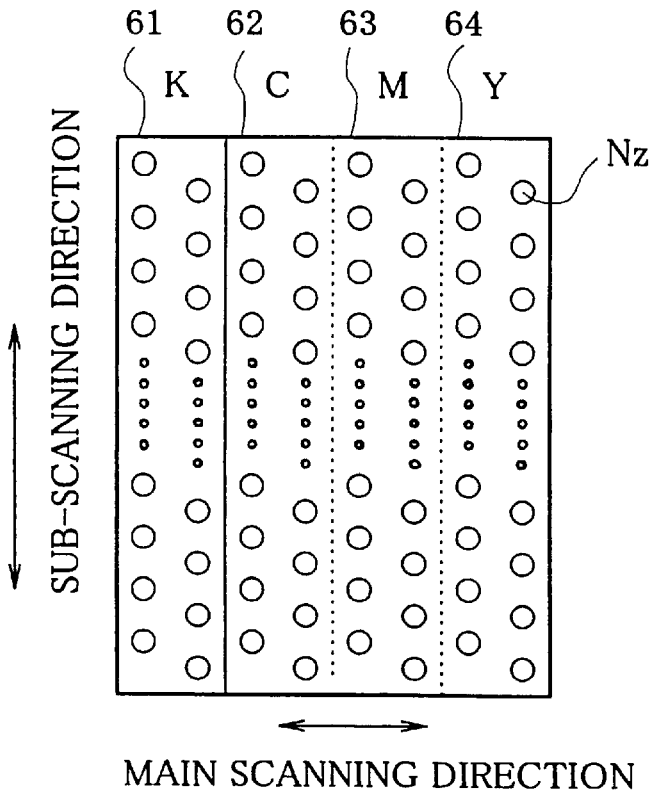
FIG. 29 shows an arrangement of nozzles Nz in print heads 61 through 64.

A black ink cartridge 71 for black ink (K) and a color ink cartridge 72 for three color inks, cyan (C), magenta (M), and yellow (Y), are detachably attached to the carriage 31. The four print heads 61 through 64 corresponding to the respective color inks are disposed in the lower portion of the carriage 31. When the ink cartridges 71 and 72 are attached to the carriage 31, supplies of inks are fed from the respective ink cartridges 71 and 72 to the print heads 61 through 64. FIG. 29 shows an arrangement of nozzles Nz in the print heads 61 through 64. In the structure of this embodiment, each of the print heads 61 through 64 has 48 nozzles Nz to eject the corresponding color ink.

Figure 30:
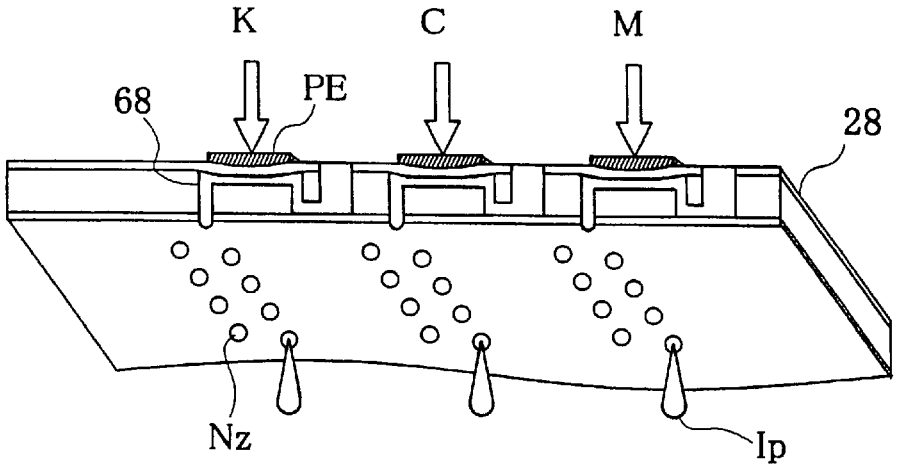
FIG. 30 schematically illustrates the internal structure of an ink ejection head 28.

The following describes the mechanism of ink ejection. FIG. 30 schematically illustrates the internal structure of an ink ejection head 28. For the clarity of illustration, only the part relating to the three color inks K, C, and M is shown. In the print heads 61 through 64, a piezoelectric element PE is provided for each nozzle. As shown in FIG. 30, the piezoelectric element PE is located to be in contact with an ink conduit 68, through which a supply of ink is fed to each nozzle Nz. As is known by those skilled in the art, the piezoelectric element PE deforms its crystal structure by application of a voltage and implements an extremely high-speed conversion of electrical energy into mechanical energy. In this embodiment, when a preset voltage is applied between electrodes on either end of the piezoelectric element PE for a predetermined time period, the piezoelectric element PE is expanded for the predetermined time period to deform one side wall of the ink conduit 68 as shown by the arrows in FIG. 30. The volume of the ink conduit 68 is reduced according to the expansion of the piezoelectric element PE. A certain amount of ink corresponding to the reduction is ejected as an ink particle Ip from the end of the nozzle Nz at a high speed. The ink particles Ip soak into the printing paper P set on the platen 26, so as to implement printing.

Figure 31:
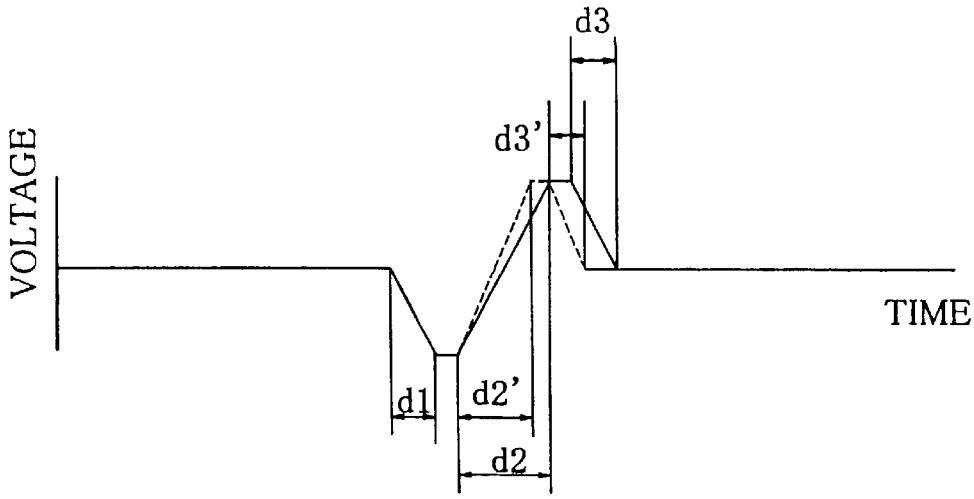
FIGS. 31, 31*a*,31*b*,31*c*, 31A, 31B and 31C show dots created by the printer PRT.
Figure 31A:
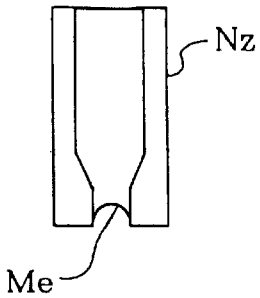
Figure 31B:
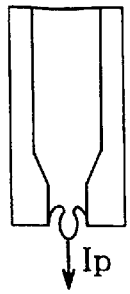
Figure 31C:
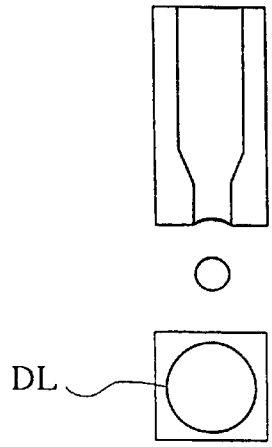
Figure 31A:
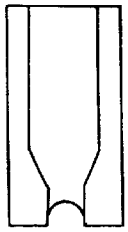
Figure 31B:
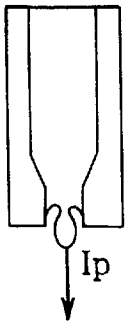
Figure 31C:
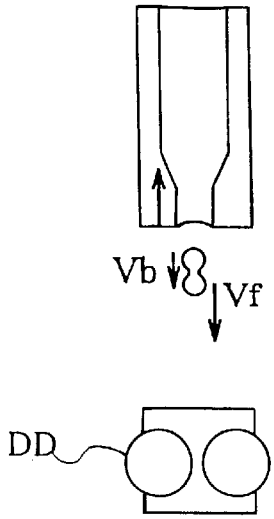

The printer PRT may create one single dot or a split dot having a plurality of divisions in each pixel. FIG. 31 shows dots created by the printer PRT. The upper graph represents a time variation of voltage (hereinafter referred to as the driving waveform) applied to the print head 28. The middle row shows formation of an ink droplet to create a single dot DL. The bottom row shows formation of an ink droplet to create a split dot DD having two divisions. The printer PRT can create dots in different dot creation states by changing the driving waveform. The printer PRT provides a driving waveform to create the single dot DL and another driving waveform to create the split dot DD and selectively uses one of the two driving waveforms to create dots in an arbitrary dot creation state in the respective pixels.

The following describes the principle of changing the dot creation state with a variation in driving waveform. As shown in the upper graph of FIG. 31, the driving waveform drops to a lower voltage than a reference voltage in a division d1. Application of such a voltage deforms the piezoelectric element provided for each nozzle in the direction of expanding the ink supply conduit. The supply of ink from the ink tank to the ink conduit can not sufficiently follow the deformation. With the expansion of the ink supply conduit, an ink interface (meniscus) Me at the end of the nozzle is thus concaved inward the nozzle.

The driving waveform then rises to a high voltage in a division d2 and ejects an ink droplet Ip according to the principle discussed previously. The ejection speed of the ink droplet Ip depends upon the gradient of the increase in voltage of the driving waveform to the high level. In the case where the voltage is raised along a relatively gentle gradient as shown in the division d2 in FIG. 31, the ink droplet Ip is ejected at a relatively low speed as defined by a state 'b'. In the case where the voltage is raised along a relatively steep gradient as shown in a division d2' in FIG. 31, on the other hand, the ink droplet Ip is ejected at a relatively high speed as defined by a state B.

After the ejection of the ink droplet Ip, the driving waveform returns to the reference voltage in a division d3 or d3' of FIG. 31. The meniscus Me has the velocity towards the end of the nozzle in the divisions d2 and d2'. The divisions d3 and d3' function to separate the ejecting ink droplet Ip from the meniscus Me by reducing the velocity of the meniscus Me. In the case where the driving waveform is returned to the reference voltage on a relatively gentle gradient as shown in the division d3, the behavior of the meniscus Me has relatively small effects on the ejecting ink droplet Ip. In this case, as shown in FIG. 31, the ink droplet Ip flies without being split and forms one single dot DL.

In the case where the driving waveform is returned to the reference voltage on a relatively steep gradient as shown in the division d3', on the other hand, the velocity of the meniscus Me is lowered abruptly. The surface tension of ink generates a force of pulling the ink droplet Ip back to the nozzle. In this case, the front division of the ink droplet Ip flies at an initial ejection velocity Vf, whereas the rear division flies at a reduced velocity Vb. A large speed difference occurs especially when the ink droplet Ip is ejected at the high flight speed in the division d2'. The variation in flight speed in the ink droplet Ip splits the ink droplet Ip into two parts, which hit against the printing paper and create a split dot DD having two divisions.

In the technique of this embodiment, the gradients in the division d2' and the division d3' are adjusted to ensure the substantially equal splits of dot. As is known, the quantity of ink to be ejected is significantly affected by the shape of the meniscus Me in the division d1. The technique of this embodiment uses the two driving waveforms having the common division d1 and creates the single dot DL and the split dot DD with a substantially identical quantity of ink.

Figure 1:
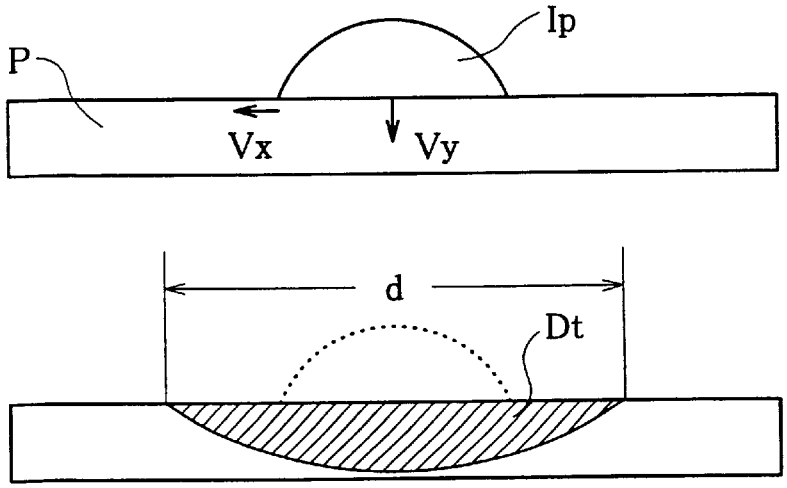
FIG. 1 shows a dot created by ejecting ink at one point in a concentrate manner.
Figure 2:
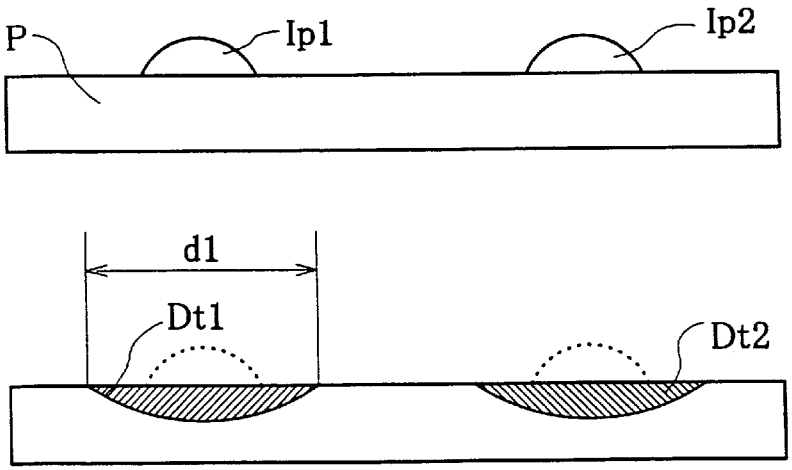
FIG. 2 shows dots created by ejecting ink in a splitting manner as two ink droplets Ip1 and Ip2.

As discussed previously with FIGS. 1 and 2, the split dot occupies a greater area than that of the single dot under the condition of a fixed quantity of ink. Creation of the split dot accordingly attains a higher density expressed in one pixel. The technique of this embodiment receives the trinary print data '0, 1, 2' with regard to the respective pixels from the computer PC and carries out printing. The larger value results in the higher density to creation of no dot, creation of the single dot DL, and creation of the split dot DD, respectively.

Figure 32:
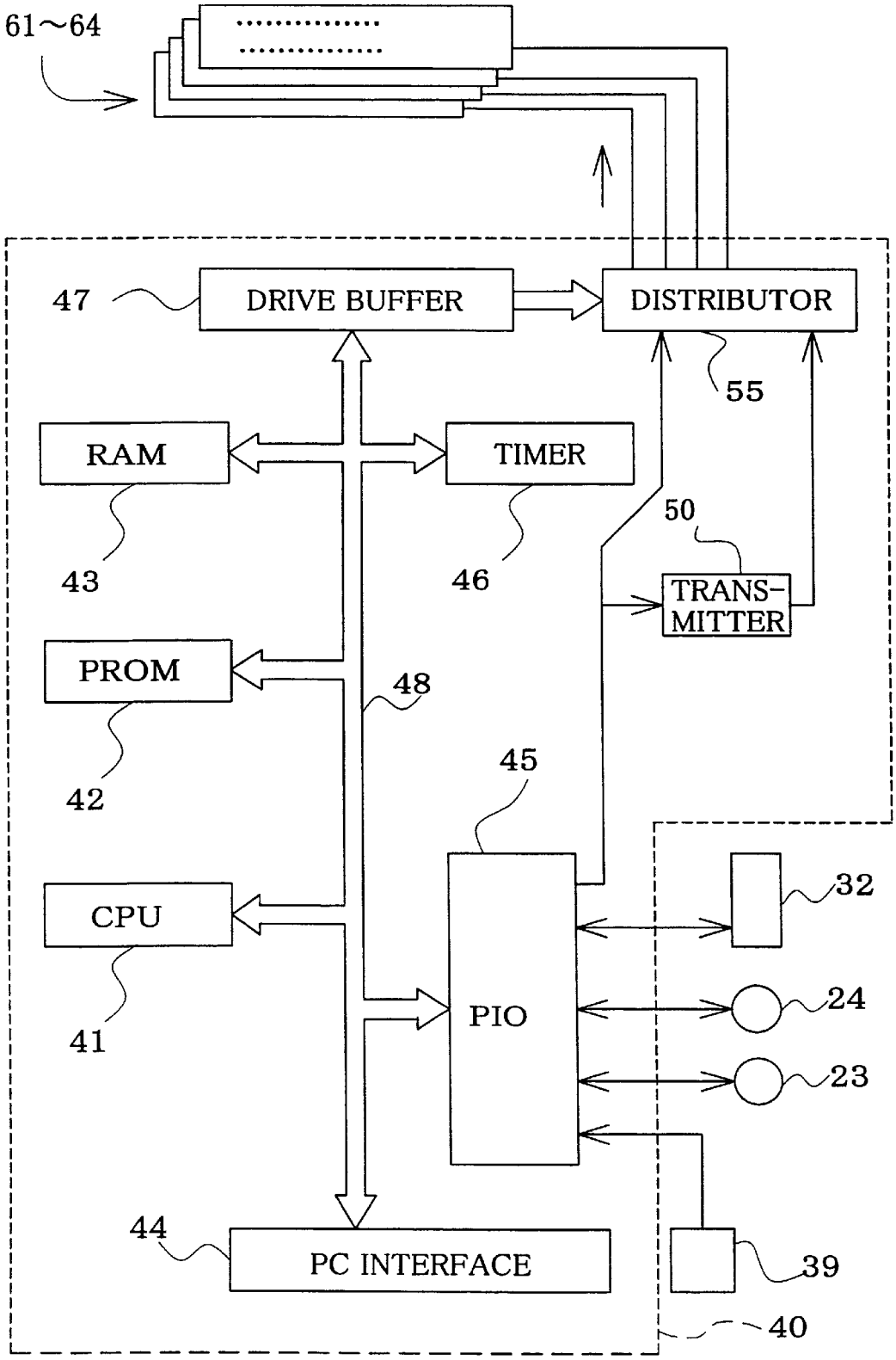
FIG. 32 illustrates the internal structure of a control circuit 40.

The ink ejection is controlled by a control circuit 40 and a transmitter 50. FIG. 32 illustrates the internal structure of the control circuit 40. The control circuit 40 includes a CPU 41, a PROM 42, a RAM 43, a PC interface 44 that transmits data to and from the computer PC, a peripheral input-output unit (PIO) 45 that transmits signals to and from the sheet feed motor 23, the carriage motor 24, and a control panel 32, a clock 46 that counts time, and a drive buffer 47 that outputs dot on-off signals to the print heads 61 through 64. These elements and circuits are mutually connected via a bus 48. The control circuit 40 also includes the transmitter 50 to output driving waveforms and a distributor 55 that distributes the outputs of the transmitter 50 into the print heads 61 through 64 at preset timings.

The control circuit 40 receives the image data processed by the computer PC, temporarily stores the input image data into the RAM 43, and outputs the stored image data to the drive buffer 47 at preset timings. The transmitter 50 outputs either one of driving waveforms W1 and W2 discussed later, in response to a control signal from the CPU 41. The drive buffer 47 determines the on-off state of the driving waveform in each pixel according to the image data and outputs the results of the determination to the distributor 55.

Figure 33:
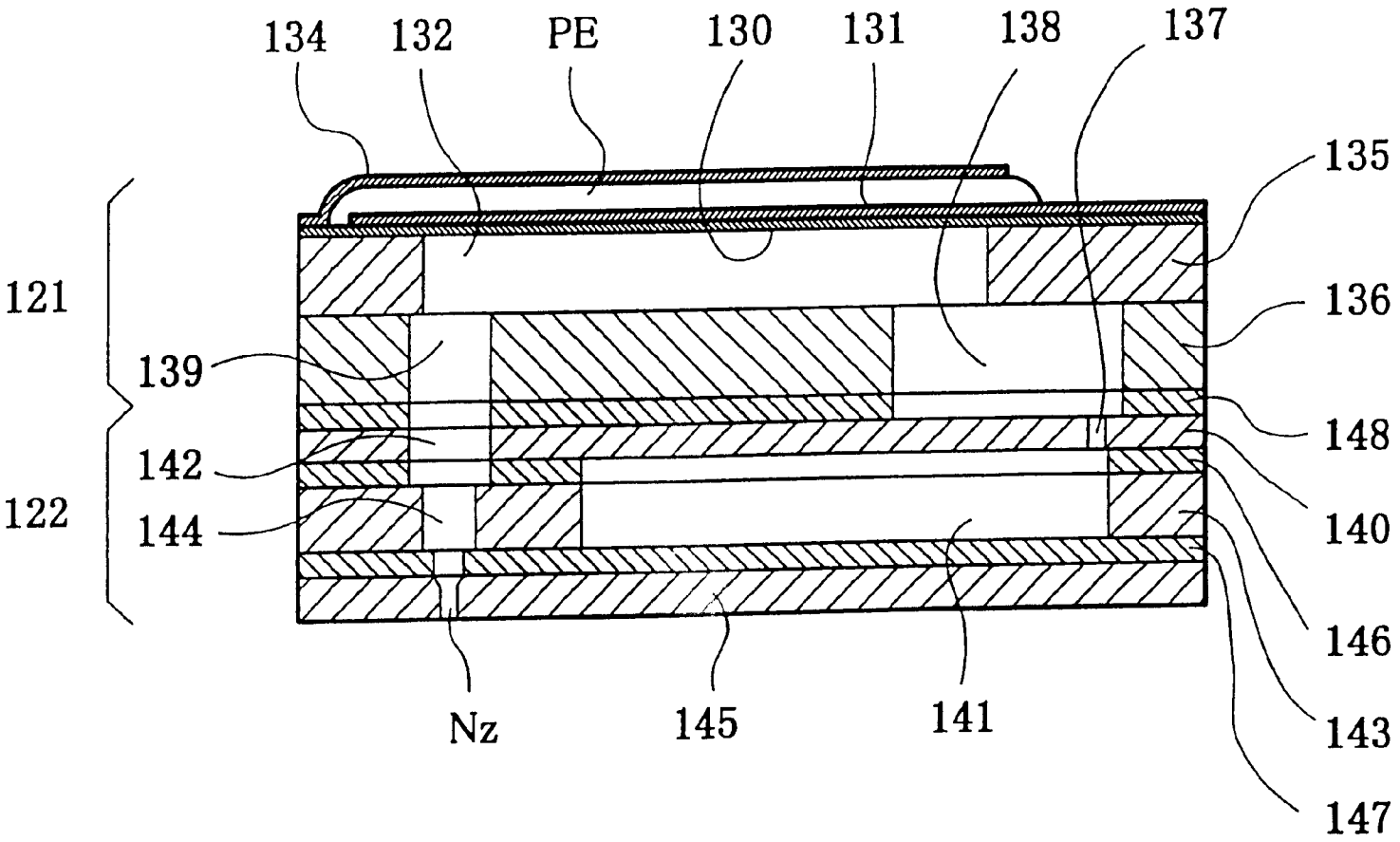
FIG. 33 shows the detailed structure of the ink ejection mechanism provided in the print head.

The structure of the print heads 61 through 64 and the driving waveforms are described in detail. FIG. 33 shows the detailed structure of the ink ejection mechanism provided in the print head. The sectional view of FIG. 33 shows the structure with regard to one nozzle. The ink ejection mechanism mainly includes an actuator unit 121 and a flow path unit 122. The actuator unit 121 has the piezoelectric element PE, a first cover member 130, a second cover member 136, and a spacer 135. The first cover member 130 is a zirconia thin plate having a thickness of approximately 6 $\mu$m. A common electrode 131, which functions as one pole, is formed on the surface of the first cover member 130. The piezoelectric element PE is fixed to the surface of the common electrode 131, and a driving electrode 134 consisting of a relatively soft metal like Au is further formed on the surface of the piezoelectric element PE.

The piezoelectric element PE functions, in combination with the first cover member 130, as a flexural oscillation actuator. The piezoelectric element PE is contracted by application of a high voltage and deforms in the direction of reducing the volume of a pressure chamber 132. The piezoelectric element PE is extended with a decrease in voltage and deforms in the direction of expanding the volume of the pressure chamber 132 to the original level.

A spacer 135 disposed below the first cover member 130 is constructed by forming a through hole in a plate of a ceramic material, such as, zirconia (($ZrO_2$), having a specific thickness suitable to form the pressure chamber 132. In this embodiment, the specific thickness is 100 $\mu$m. Both faces of the spacer 135 are sealed with the second cover member 136 and the first cover member 130 to define the pressure chamber 132.

The second cover member 136 is fixed to the other end of the spacer 135. The second cover member 136 is composed of a ceramic material, such as zirconia. Two connection apertures 138 and 139 are formed in the second cover member 136 to combine with the pressure chamber 132 and construct an ink conduit. The connection aperture 138 connects an ink supply inlet 137, which will be discussed later, with the pressure chamber 132, whereas the connection aperture 139 connects the nozzle opening Nz with the other end of the pressure chamber 132.

These members 130, 135, and 136 are assembled as the actuator unit 121 without using an adhesive by molding a clay-like ceramic material to predetermined shapes, laying the shaped molds one upon another, and firing the layered object.

The flow path unit 122 is described here. The flow path unit 122 includes an ink supply inlet-forming base plate 140, an ink chamber-forming base plate 143, and a nozzle plate 145. The ink supply inlet-forming base plate 140 has the ink supply inlet 137 formed on one end facing the pressure chamber 132 and the nozzle opening Nz on the other end. The ink supply inlet-forming base plate 140 also works as a fixation base plate of the actuator unit 121. The ink supply inlet 137 is a connection conduit that connects an ink chamber 141 common to the respective nozzles and the pressure chamber 132. The cross section of the ink supply inlet 137 is sufficiently smaller than the area of the connection hole 138 and functions as an orifice.

The ink chamber-forming base plate 143 joins with the ink supply inlet-forming base plate 140 to define the ink chamber 141. One face of the ink chamber-forming base plate 143 opposite to the ink supply inlet-forming base plate 140 is sealed with a nozzle plate 145. The ink chamber-forming base plate 143 has a nozzle connection aperture 144 connecting with the nozzle Nz. The ink chamber 141 is connected to the ink conduit 68 leading to the ink cartridges 71 and 72. The ink conduit 68 is omitted from the illustration of FIG. 33.

The ink supply inlet-forming base plate 140, the ink chamber-forming base plate 143, and the nozzle plate 145 are fixed to one another via interposed adhesive layers 146 and 147 composed of, for example, a thermally welding film or an adhesive, and constitute the flow path unit 122 as a whole. The flow path unit 122 and the actuator unit 121 described previously are fixed to each other via an adhesive layer 148 composed of, for example, a thermal welding film or an adhesive, to form each of the print heads 61 through 64.

In response to an applied voltage between the driving electrodes 131 and 134 of the piezoelectric element PE, the piezoelectric element PE is contracted to reduce the volume of the pressure chamber 132. This raises the pressure in the ink conduit 68 and causes ink to be ejected from the nozzle Nz. In response to a drop of the voltage, on the contrary, the piezoelectric element PE is extended to increase the volume of the pressure chamber 132. The expansion of the pressure chamber 132 lowers the ink pressure in the ink conduit 68. The decrease in pressure causes a supply of ink to be fed from the ink tank to the ink conduit 68. The state of the ink interface or the meniscus Me of the nozzle Nz varies with the decrease in pressure. The technique of this embodiment outputs the two voltage waveforms as the driving waveforms to the print heads 61 through 64 to create dots in different dot creation states as described below.

Figure 34:
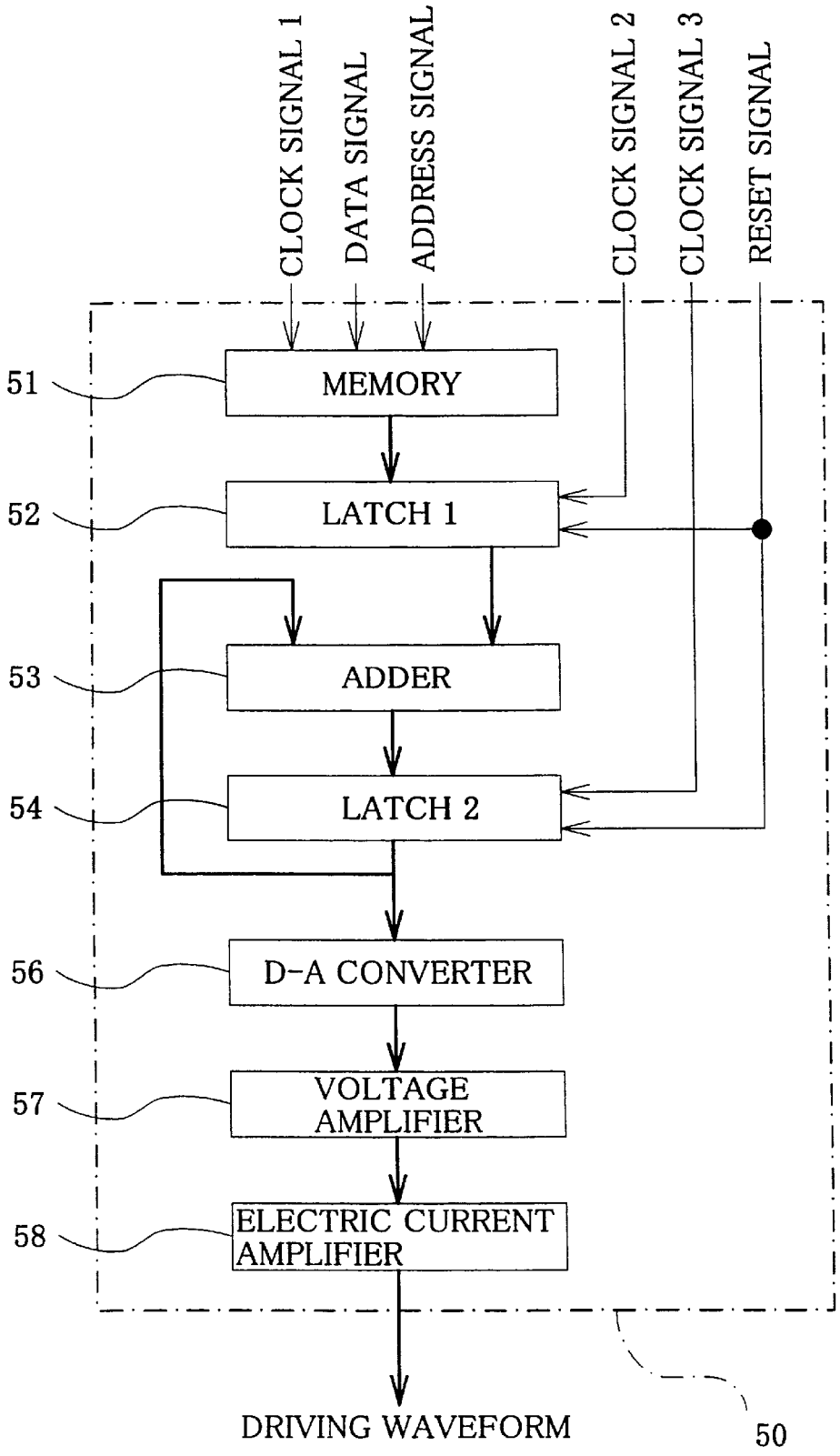
FIG. 34 shows the internal structure of a transmitter 50.

The following describes generation of the driving waveforms. FIG. 34 shows the internal structure of the transmitter 50. The transmitter 50 includes a memory 51 that stores parameters specifying the shape of the driving waveform, a latch 52 that reads the contents of the memory 51 and temporarily holds the read-out contents, an adder 53 that sums up the output of this latch 52 and the output of another latch 54, a D-A converter 56 that converts the output of the latch 54 into analog data, a voltage amplifier 57 that amplifies the converted analog signal to a specific voltage amplitude level for driving the piezoelectric element PE, and an electric current amplifier 58 that supplies the electric current corresponding to the amplified voltage signal. As mentioned previously, the memory stores preset parameters that specify the driving waveform. As illustrated in FIG. 34, clock signals 1, 2, and 3, a data signal, an address signal, and a reset signal are input into the transmitter 50.

The clock signals 1, 2, and 3 are three different timing signals output from the clock 46 in the control circuit 40. The clock signal 1 specifies the timing of synchronization in the process of inputting the data signal into the memory 51. The clock signal 2 specifies the timing of changing over the data used for generation of the driving waveform among a plurality of slew rates stored in the memory 51. The clock signal 3 specifies the timing of a voltage variation of the driving waveform.

Figure 35:
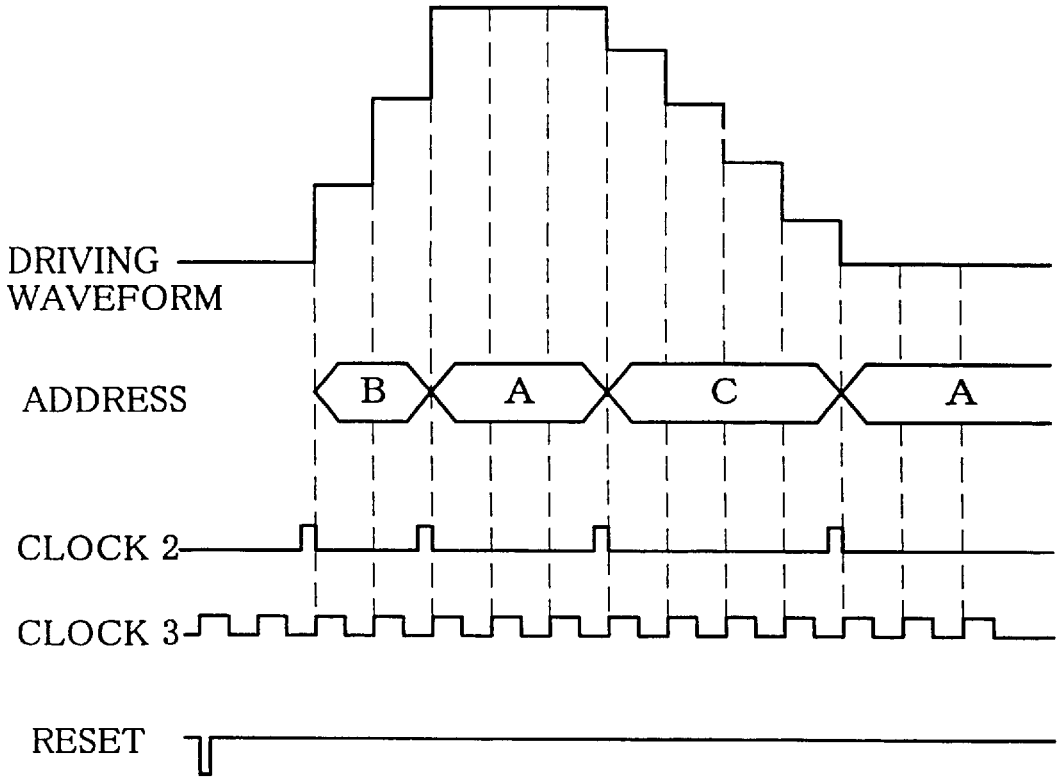
FIG. 35 shows a process of generating the driving waveform.

FIG. 35 shows a process of generating the driving waveform. Prior to generation of the driving waveform, several data representing the slew rates of the driving signal are sent to the memory 51. The slew rate represents a voltage variation per unit time. The positive slew rate raises the voltage at a preset rate of change, and the negative slew rate lowers the voltage at a preset rate of change. Sixteen slew rates at the maximum may be registered at respective addresses in the memory 51. In this illustrated example, three data are registered at addresses A, B, and C, respectively.

When the address B is specified at the time point of starting generation of the driving waveform, the slew rate allocated to the address B is held by the first latch 52 in synchronism with the clock signal 2. The summation obtained by successively adding the slew rate registered at the address B is held by the second latch 54 in synchronism with the clock signal 3. The voltage output from the transmitter 50 varies with a variation in output of the second latch 54.

When the address A is specified subsequently, the slew rate allocated to the address A determines the rate of change of the voltage. In this embodiment, the slew rate registered at the address A is equal to zero. As shown in the chart, the voltage is accordingly kept flat in the division where the address A is specified. A negative value is set to the slew rate allocated to the address C. The voltage accordingly drops at a fixed rate in the division where the address C is specified.

Transmitting the address signal and the clock signal 2 to the transmitter 50 as described above varies the voltage at various rates of change, so as to generate a driving waveform. The technique of this embodiment adopts this process to generate two driving waveforms that attain different dot creation states on the printing medium.

Figure 36:
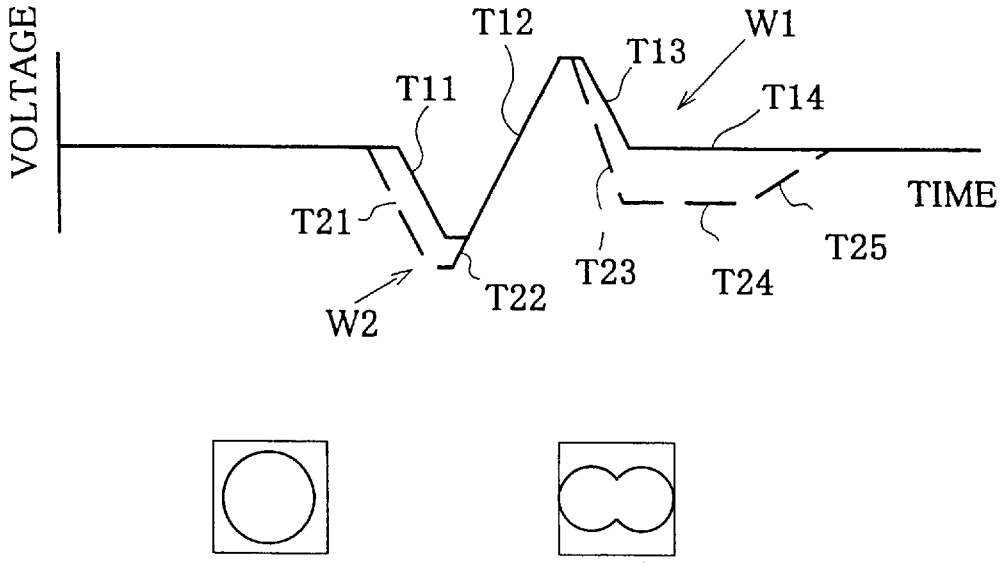
FIG. 36 shows the driving waveforms generated in the embodiment.

FIG. 36 shows the driving waveforms generated in this embodiment. As described above, the technique of this embodiment generates two driving waveforms W1 and W2. These two driving waveforms W1 and W2 are selectively used according to the type of the printing medium and other printing conditions under the control of the CPU 41. As shown in the graph, either of the driving waveforms first lowers the voltage from a reference level (see voltages T11 and T21), then raises the voltage (see voltages T12 and T22), and drops the voltage (see voltages T13 and T23) again. The driving waveform W1 follows the waveform T13 and drops the voltage to the reference level (see voltage T14). The driving waveform W2, on the other hand, follows the waveform T23 and drops the voltage below the reference level (see voltage T24). The driving waveform W2 then gently raises the voltage to the reference level (see voltage T25). The two driving waveforms have the common shape in the phase of the voltage rise, that is, the voltages T12 and T22, but have different parameters in the phase of the voltage drop.

Figure 4:
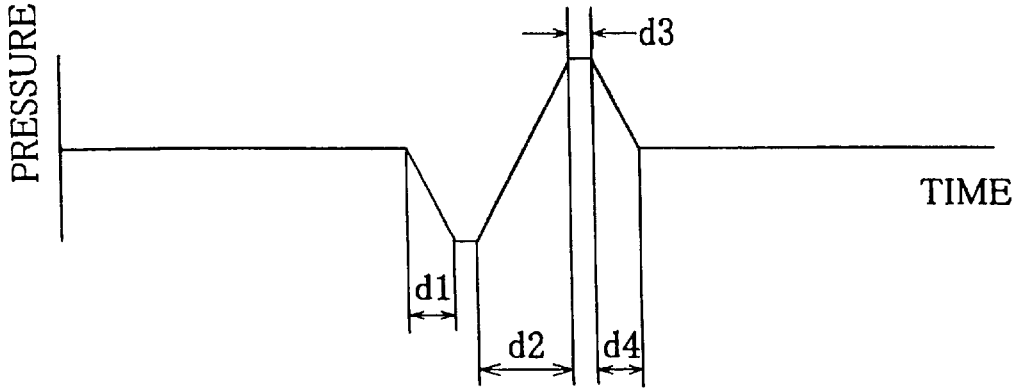
FIGS. 4, 4*a*, 4*b* and 4*c* show ejection of an ink droplet in response to a driving waveform applied a print head.
Figure 4A:
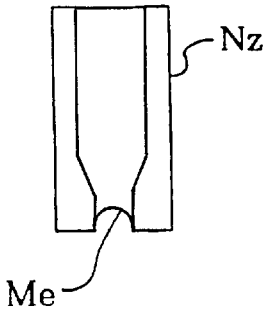
Figure 4B:
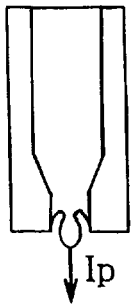
Figure 4C:
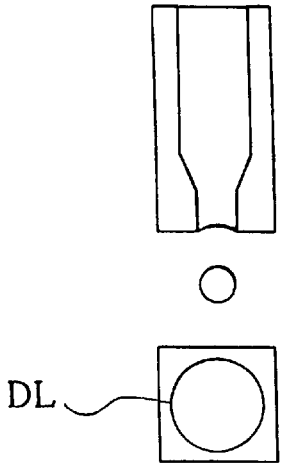
Figure 5:
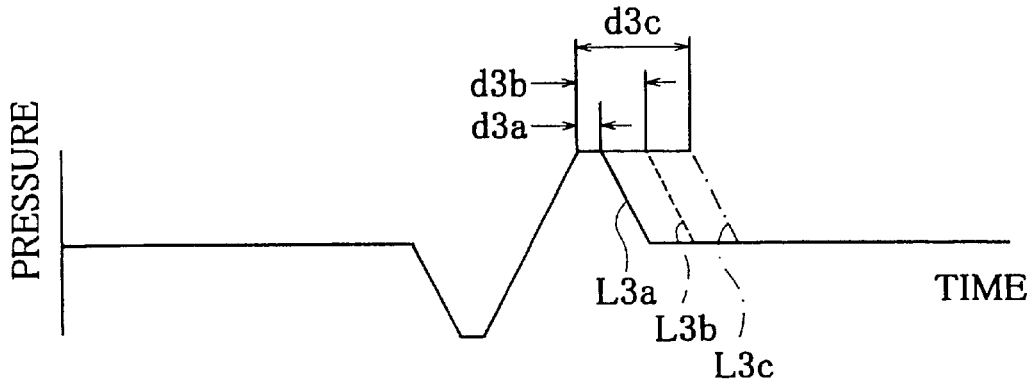
FIG. 5 shows a variation in pressure waveform with a change of a first parameter
Figure 6:
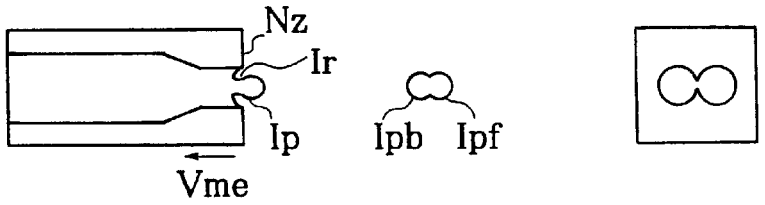
FIG. 6 shows the state of an ink droplet when the pressure is reduced at the earliest timing.
Figure 7:
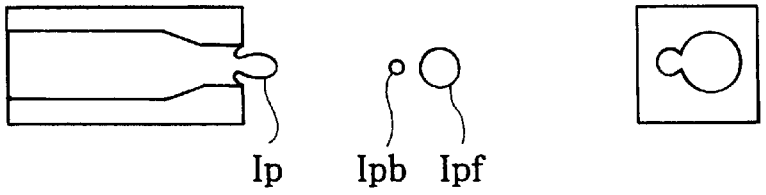
FIG. 7 shows the state of an ink droplet when the pressure is reduced at the intermediate timing.
Figure 8:
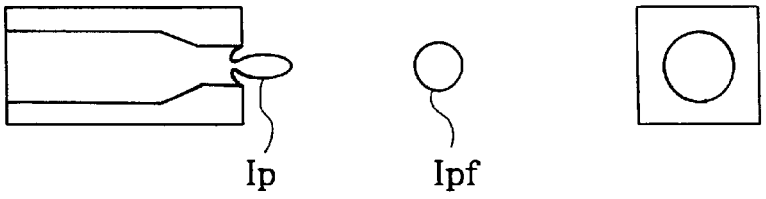
FIG. 8 shows the state of an ink droplet when the pressure is reduced at the slowest timing.
Figure 9:
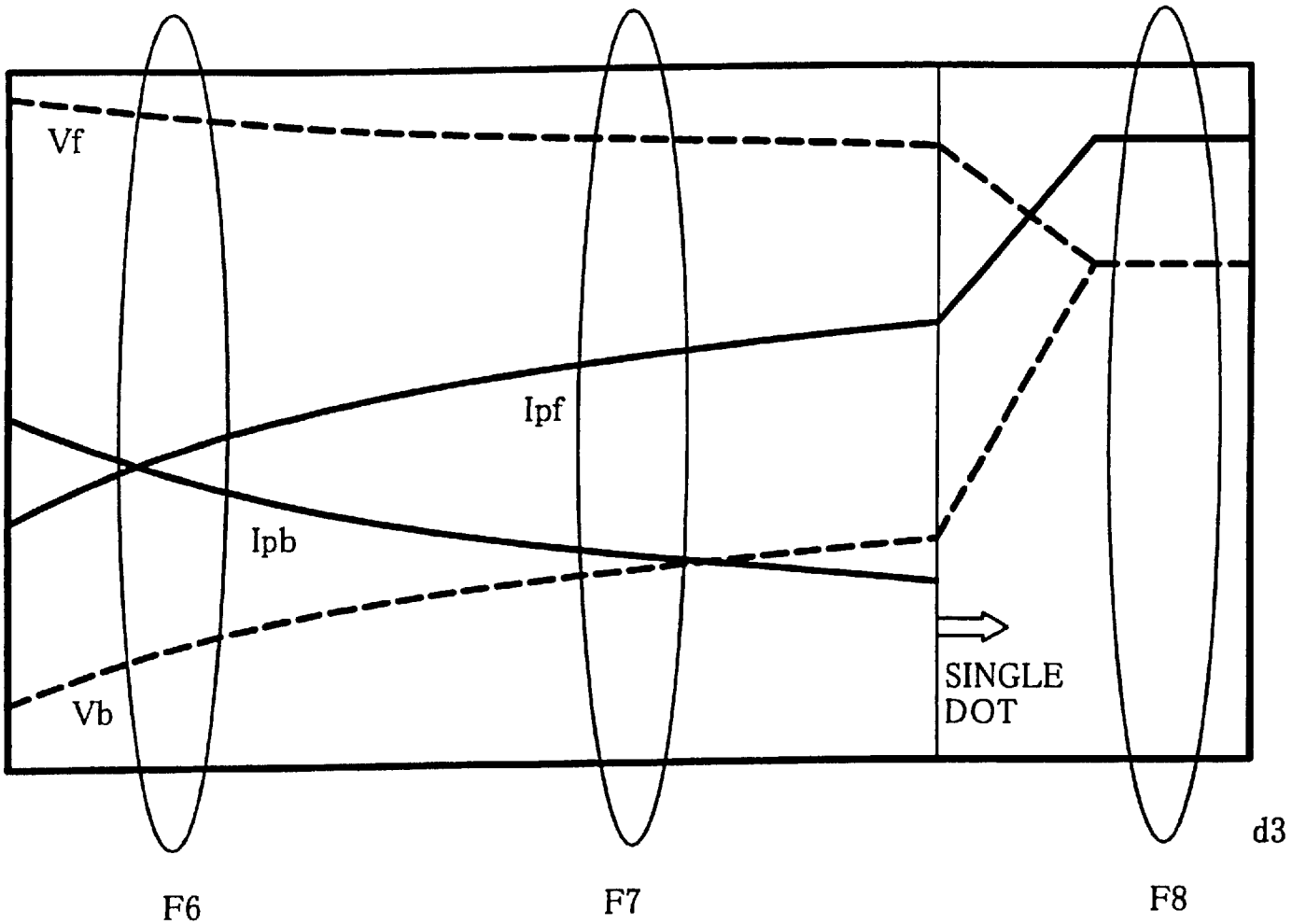
FIG. 9 is a graph showing the results of experiments varying the first parameters
Figure 10:
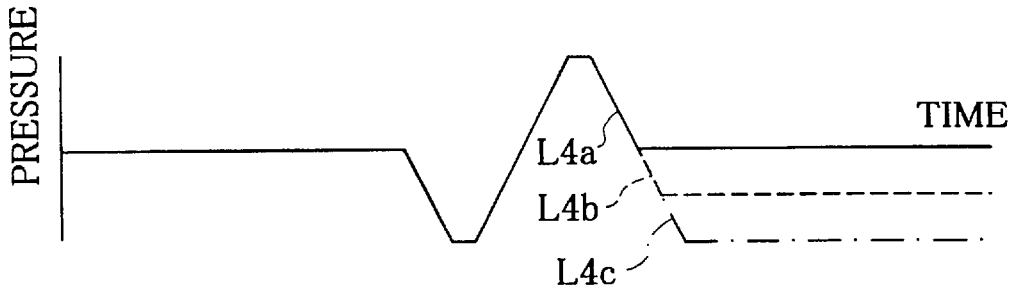
FIG. 10 shows a variation in pressure waveform with a change of a second parameter.
Figure 11:
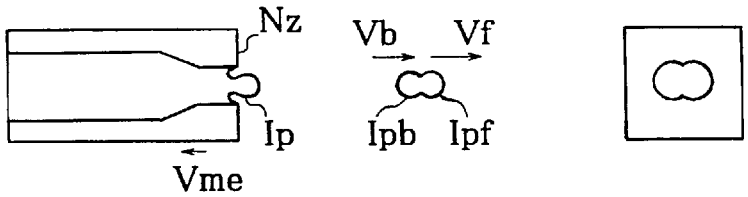
FIG. 11 shows the state of an ink droplet under the condition of a smallest quantity of pressure reduction.
Figure 12:
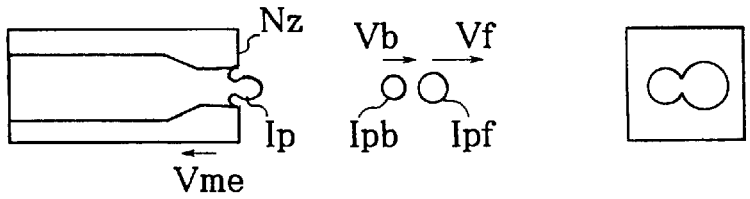
FIG. 12 shows the state of an ink droplet under the condition of an intermediate quantity of pressure reduction.
Figure 13:
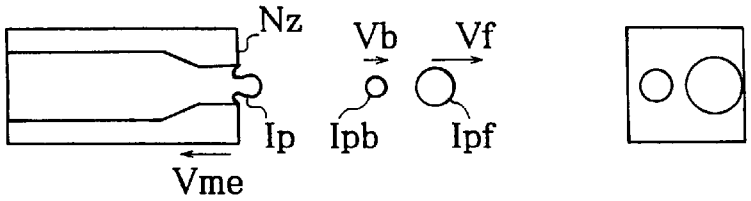
FIG. 13 shows the state of an ink droplet under the condition of a largest quantity of pressure reduction.
Figure 14:
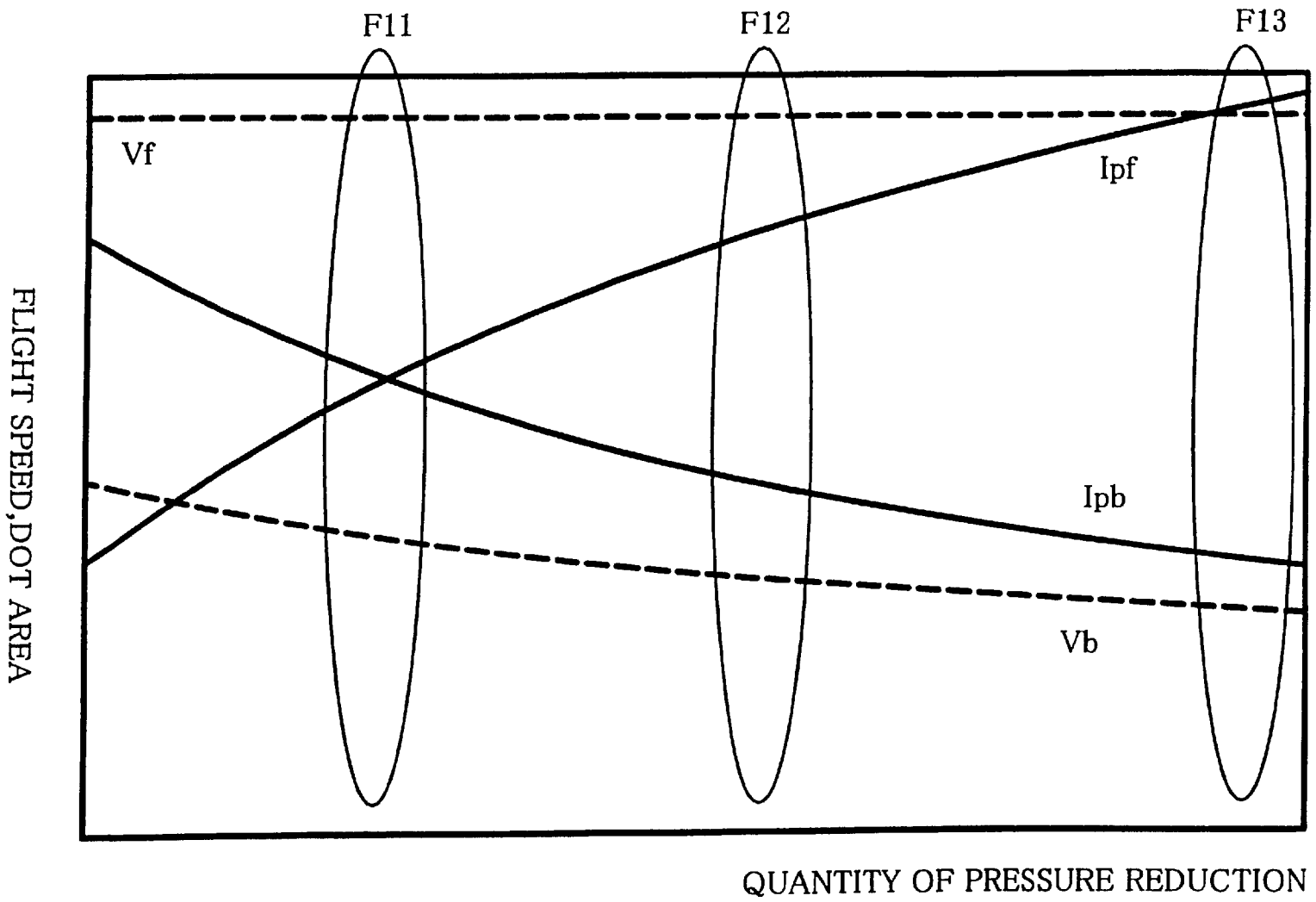
FIG. 14 is a graph showing the results of experiments varying the second parameter.
Figure 15:
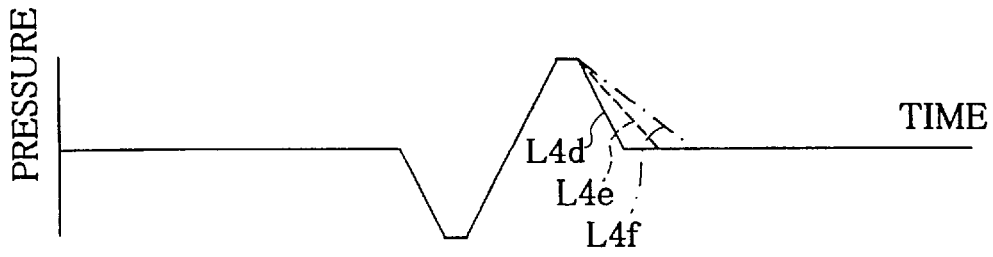
FIG. 15 shows a variation in pressure waveform with a change of a third parameter.
Figure 16:
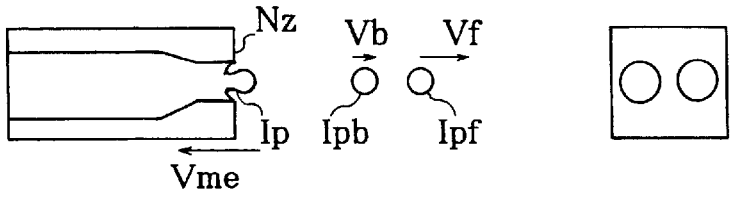
FIG. 16 shows the state of an ink droplet under the condition of a largest rate of change in pressure reduction.
Figure 17:
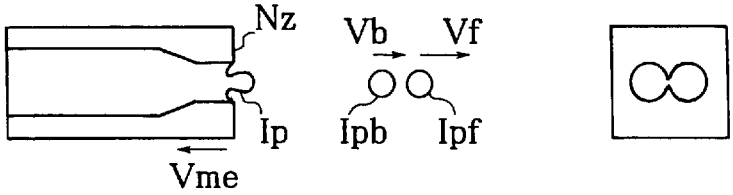
FIG. 17 shows the state of an ink droplet under the condition of an intermediate rate of change in pressure reduction.
Figure 18:
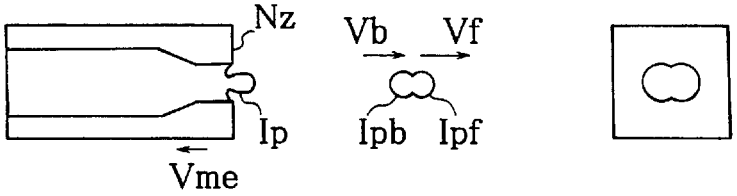
FIG. 18 shows the state of an ink droplet under the condition of a largest rate of change in pressure reduction.
Figure 19:
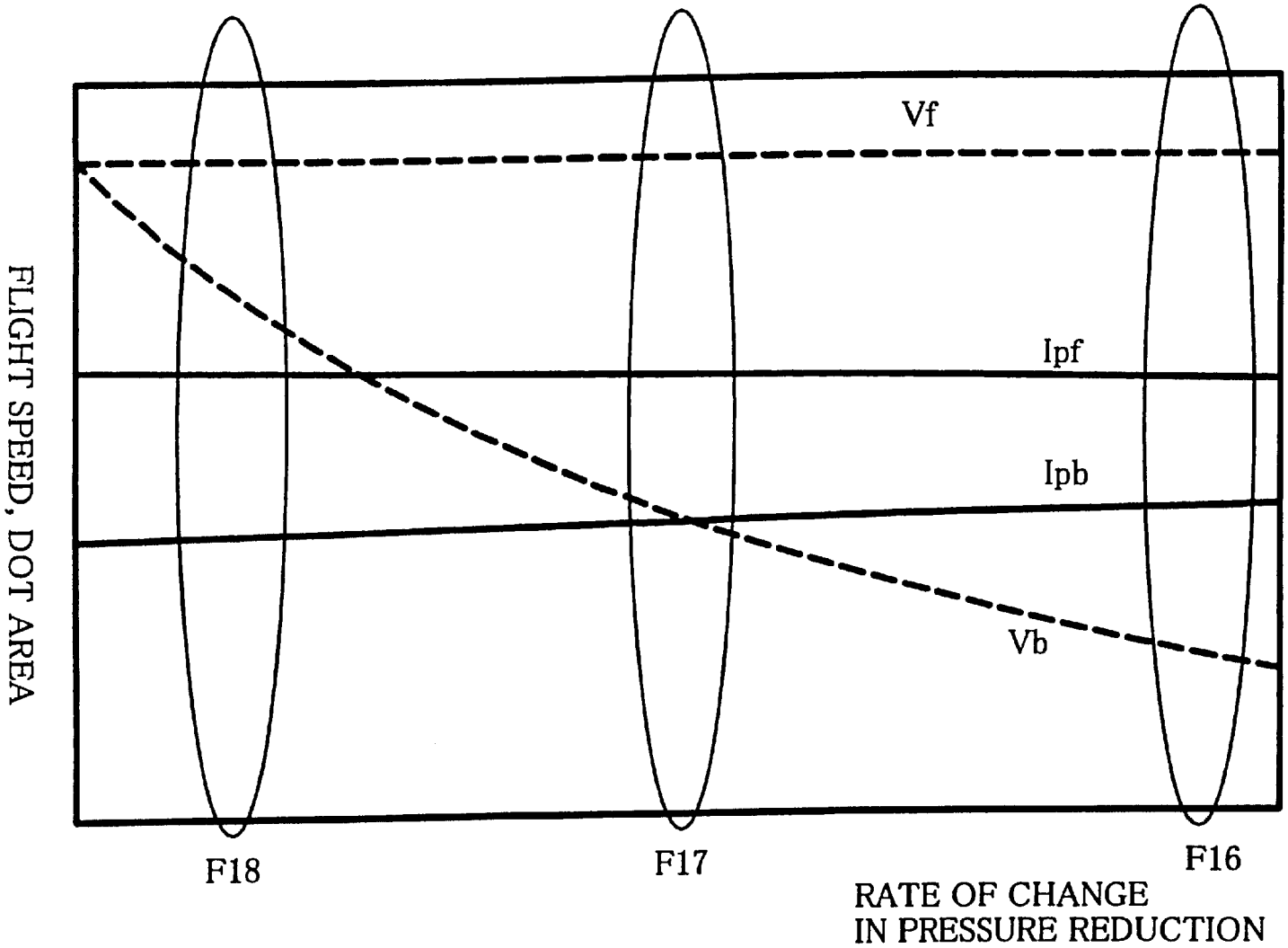
FIG. 19 is a graph showing the results of experiments varying the third parameter.
Figure 20:
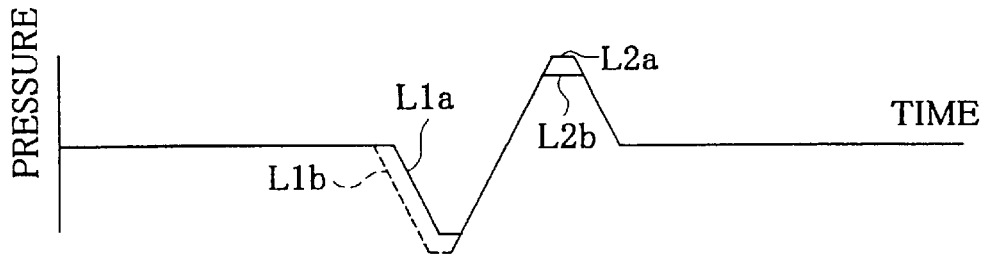
FIG. 20 shows variation in pressure waveform with a change of the quantity of pressure reduction in a division d1.
Figure 21:
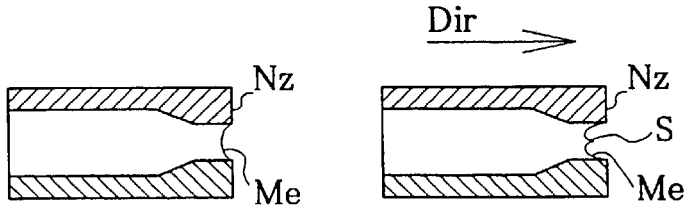
FIG. 21 shows he state of a meniscus Me according to the variation in quantity of pressure reduction.
Figure 22:
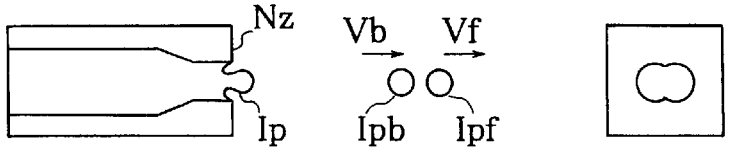
FIG. 22 shows the state of an ink droplet in the case of a small quantity of pressure reduction.
Figure 23:
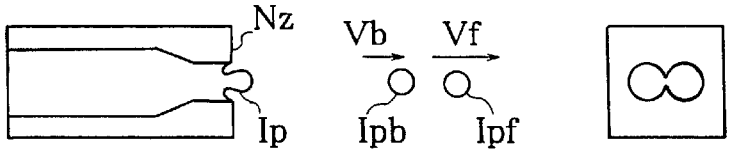
FIG. 23 shows the state of an ink droplet in the case of a large quantity of pressure reduction.
Figure 24:
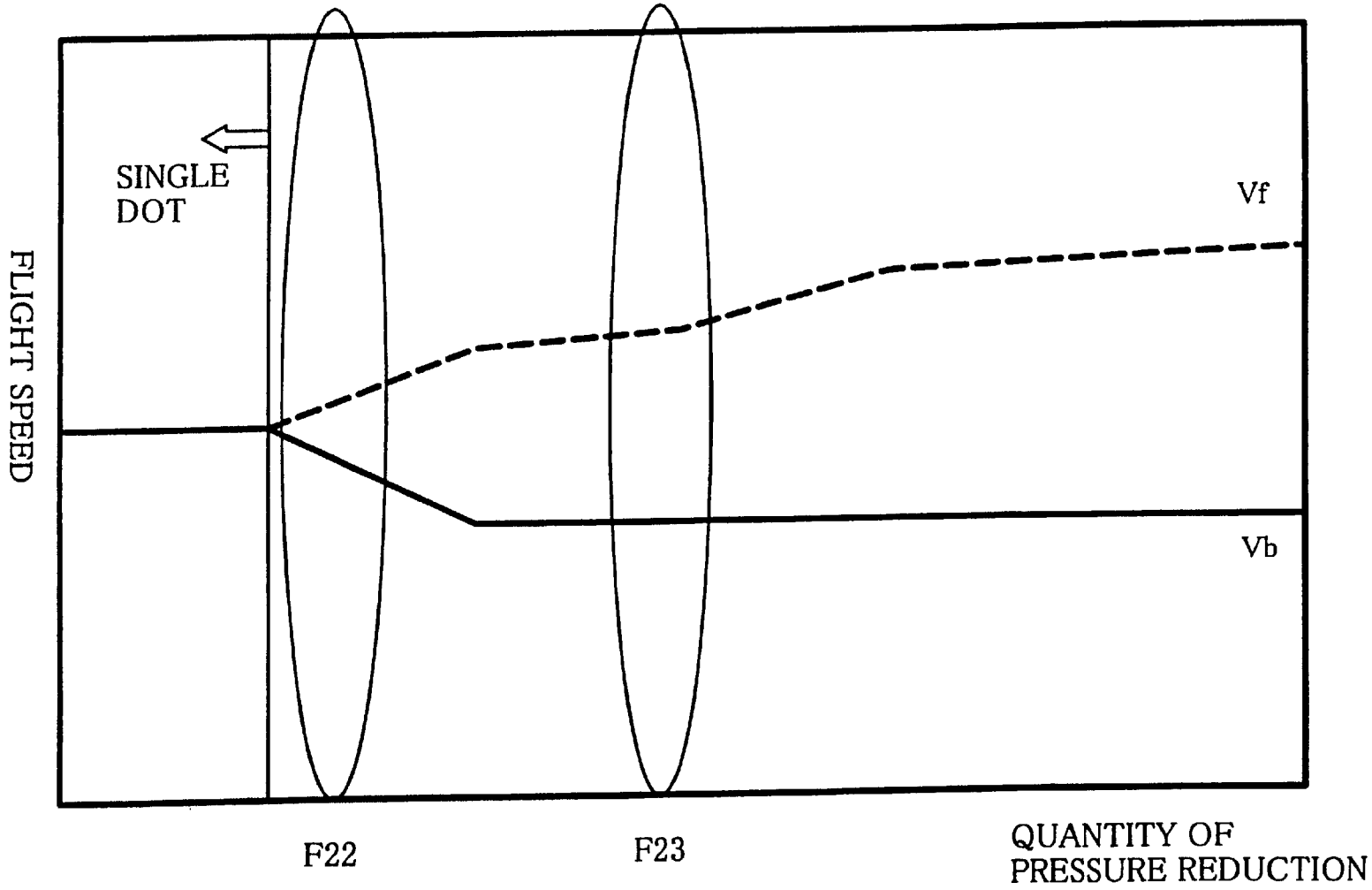
FIG. 24 is a graph showing the results of experiments when the quantity of speed reduction is changed in the division d1.

FIG. 36 also shows dots created by the respective driving waveforms. A single dot shown in the left part of the drawing is created in response to the driving waveform W1. As shown on the right side of the drawing, a split dot having two divisions is created in response to the driving waveform W2. The driving waveform W1 corresponds to the pressure waveform shown in the upper graph of FIG. 4. In the division d1 corresponding to the voltage T11, the supply of ink from the ink tank does not sufficiently follow the decrease in pressure, and the meniscus M3 is concaved inward the nozzle Nz (state 'a' in FIG. 4). Application of the voltage T12 causes an ink droplet to be ejected from the substantial center of the meniscus Me (state 'b' in FIG. 4). Subsequent application of the voltage T13 reduces the velocity of the meniscus Me towards the nozzle end to exert the damping effects.

The steep gradient of the voltage T11 abruptly lowers the pressure and raises the rate of insufficiency of ink supply, thereby increasing the curvature of the meniscus Me. As is known to the art, the quantity of ink ejection is affected by the curvature of the meniscus Me at the time of ejection. In the driving waveforms W1 and W2 used in this embodiment, the voltages T11 and T21 have an identical gradient, so that substantially equal quantities of ink are ejected.

In the driving waveforms W1 and W2, the voltages T12 and T21 have different quantities of reduction, and the voltages T13 and T23 have different timings of reduction, different quantities of reduction, and different rates of change. These parameters affect the dot creation state.

The difference in timing of reduction between the voltages T13 and T23 affects the size and the flight speed of the rear division of the split dot as shown in FIGS. 5 through 8. The difference in quantity of reduction between the voltages T13 and T23 affects the flight speed of the rear division of the split dot and varies the hitting positions of the front division and the rear division of the split dot against the printing medium as shown in FIGS. 10 through 13. The difference in rate of change between the voltages T13 and T23 varies the hitting positions of the front division and the rear division of the split dot against the printing medium as shown in FIGS. 15 through 18. The difference in quantity of reduction between the voltages T12 and T21 affects the velocity of the front division Ipf of the ink droplet Ip and the interval between the respective divisions of the split dot as shown in FIGS. 20 through 23.

As described above, varying any of these parameters relating to the pressure reduction after the ejection of the ink droplet Ip specifies the dot creation state. In order to attain a desired dot creation state, these parameters are set experimentally or by another appropriate method according to the configuration of the print head. The technique of this embodiment sets the variety of parameters discussed above to ensure creation of two dots having a substantially identical size. Although this embodiment regards the case of splitting the ink droplet into two dots, varying the driving waveform in other ways enables creation of many different dots including dots of different quantities of ink.

In the printer PRT having the hardware structure discussed above, while the sheet feed motor 23 feeds the sheet of printing paper P (hereinafter referred to as the subscan), the carriage motor 24 reciprocates the carriage 31 (hereinafter referred to as the main scan), simultaneously with actuation of the piezoelectric elements PE on the respective ink ejection heads 61 through 64 of the print head 28. The printer PRT accordingly ejects the respective color inks to create dots and thereby forms a multi-color image on the printing paper P.

In this embodiment, the printer PRT has the print head that uses the piezoelectric elements PE to eject ink as discussed previously. The printer may, however, apply another method for ink ejection. The technique of the present invention is applicable, for example, to a printer that supplies electricity to a heater disposed in an ink conduit and utilizes the bubbles generated in the ink conduit to eject ink.

B. Control of Dot Creation

Figure 37:
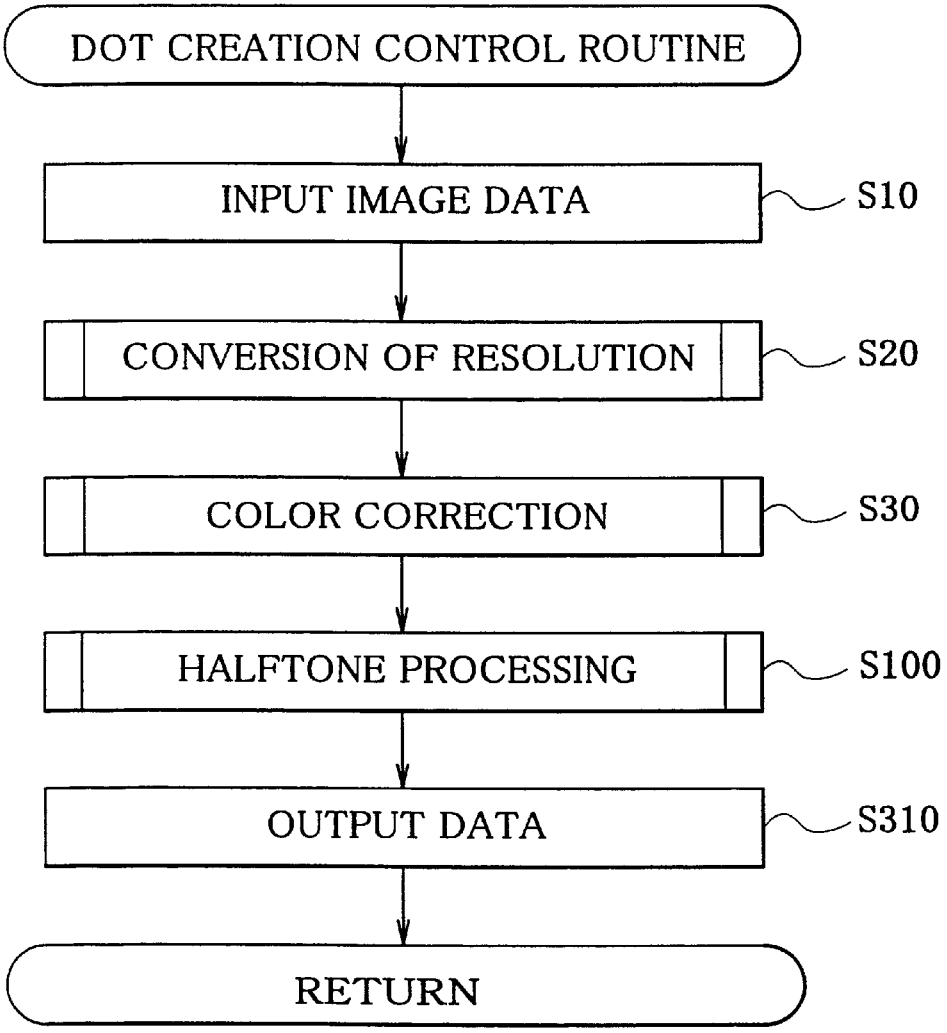
FIG. 37 is a flowchart showing a dot creation control routine.

FIG. 37 is a flowchart showing a dot creation control routine executed by the CPU 81 of the computer PC. When the program enters this routine, the CPU 81 first inputs image data (step S10). The image data are transferred from the application program 95 and have tone values in the range of 0 to 255 with regard to the respective colors R, G, and B in each of the pixels constituting the image. The resolution of the input image data depends upon the resolution of the original image data ORG.

The CPU 81 converts the resolution of the input image data into the printing resolution in the printer PRT according to the requirements (step S20). In the case where the resolution of the image data is lower than the printing resolution, the conversion of resolution is implemented by carrying out linear interpolation and generating new data between the existing pieces of the original image data. In the case where the resolution of the image data is higher than the printing resolution, on the contrary, the conversion of resolution is implemented by skipping existing pieces of the original image data at a preset rate. In the case where the resolution of the input image data is in a printable resolution range of the printer, such conversion may be omitted.

The CPU 81 subsequently carries out color correction (step S30). The color correction converts the image data of the R, G, and B tone values into the tone value data of the C, M, Y, and K inks used in the printer PRT. The procedure of color correction refers to the color correction table LUT (see FIG. 26), which stores combinations of the respective inks used in the printer PRT to express colors specified by respective combinations of R, G, and B. A variety of known techniques are applicable to the process of color correction using the color correction table LUT. For example, the interpolation technique may be applied for the color correction.

The CPU 81 causes the color-corrected image data to be subjected to halftone processing with regard to each color ink. The halftone processing converts the tone value of the original image data (256 tones in this embodiment) into the tone value expressible by the printer PRT with regard to each pixel. The technique of this embodiment carries out the halftone processing to three tones, that is, 'creation of no dot', 'creation of the single dot DL', and 'creation of the split dot DD'.

Figure 38:
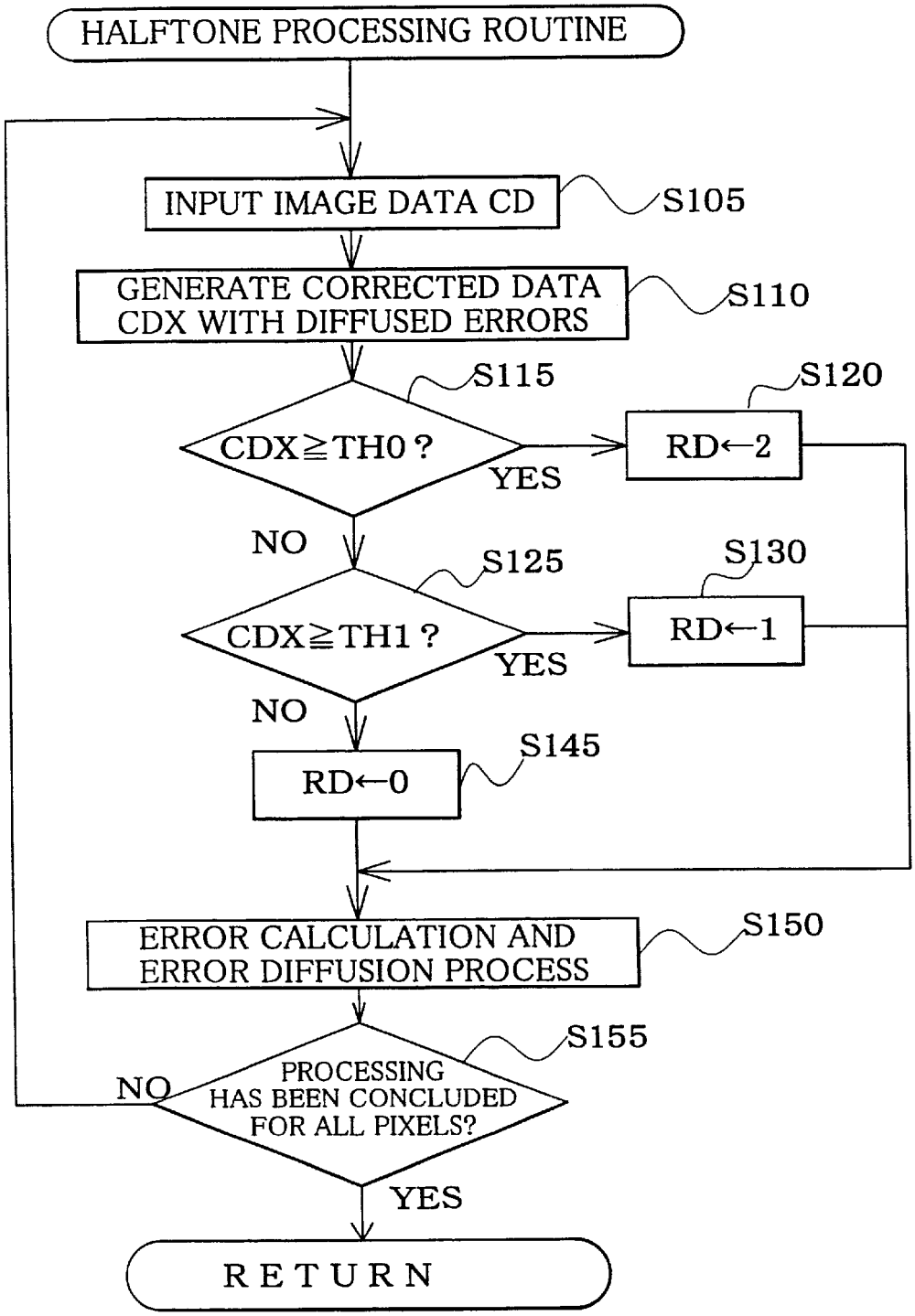
FIG. 38 is a flowchart showing a halftone processing routine.

FIG. 38 is a flowchart showing a halftone processing routine. Any of various known methods, such as the error diffusion method or the dither method, is applicable for the halftone processing. The technique of this embodiment applies the error diffusion method, which advantageously ensures the excellent image quality, for the halftone processing.

Figure 39:
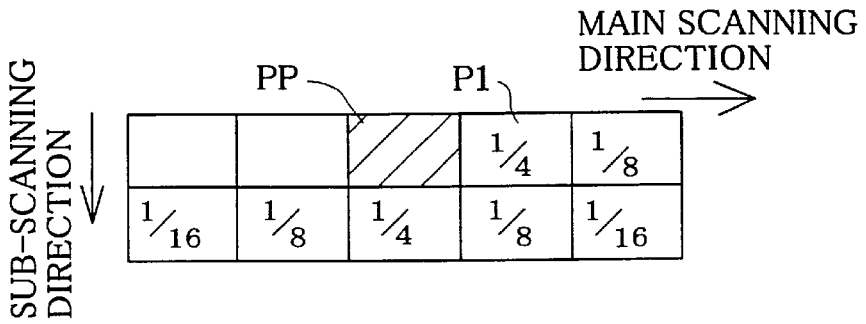
FIG. 39 shows weights of error diffusion.

When the program enters this processing routine, the CPU 81 first inputs image data CD (step S105), and causes the results of error diffusion to be reflected on the image data CD to generate corrected data CDX (step S110). The error diffusion method diffuses a local density error arising in a processed pixel, which has just been subjected to the dot on-off determination, to peripheral non-processed pixels in a predetermined proportion. A pixel of interest, which is the current target of the dot on-off determination, has the tone data with the errors diffused from the peripheral processed pixels reflected thereon. The density error arising as the result of the dot on-off determination in the pixel of interest is further diffused to peripheral non-processed pixels. An exemplified proportion of the error diffusion is shown in FIG. 39. The density error arising in a pixel of interest PP is diffused to several pixels aligned in the main scanning direction and in the sub-scanning direction in the proportion specified in FIG. 39. In order to allow the dot on-off determination under such conditions, the processing of step S110 adds the diffused errors to the input image data CD to generate the corrected data CDX.

The corrected data CDX thus generated is then compared with a predetermined threshold value TH0 (step S115). When the corrected data CDX is not less than the predetermined threshold value TH0, the CPU 81 determines that the 'split dot DD' having the highest density evaluation value are to be created, and substitutes a value '2' into a resulting value RD representing the result of the determination (step S120). The resulting value RD is data to be transferred to the printer PRT as the print data FNL, and the value '2' represents creation of the split dot DD.

When the corrected data CDX is less than the predetermined threshold value TH0, on the other hand, the corrected data CDX is further compared with a second threshold value TH1 (step S125). In the case where the corrected data CDX is not less than the second threshold value TH1, the CPU 81 determines that the 'single dot DL' having the low density evaluation value is to be created, and substitutes a value '1' into the resulting value RD representing the result of the determination (step S130). The value '1' represents creation of the single dot DL.

In the case where the corrected data CDX is less than the second threshold value TH1, the CPU 81 determines that no dot is to be created, and substitutes a value '0' into the resulting value RD (step S145). The value '0' represents creation of no dot.

The threshold values TH0 and TH1 are used as the criterion of dot on-off determination, and any value may be set to these threshold values TH0 and TH1. In this embodiment, the density evaluation value of the split dot or the maximum tone value (the value '256') of the image data is set to the threshold value TH0. Half the density evaluation value of the single dot is set to the second threshold value TH1.

After determining the dot on-off state, the CPU 81 calculates an error based on the resulting value RD and carries out the error diffusion process (step S150). The error represents a difference between the density expressed by the dot created in the pixel of interest PP according to the result of the multi-valuing process and the density to be expressed in the pixel of interest PP according to the corrected data CDX. The density expressed by the dot created in the pixel of interest PP is determined, based on preset density evaluation values RVL and RVD with regard to the single dot DL and the split dot DD.

The error ERR is obtained from the corrected data CDX and the density evaluation values RVL and RVD according to 'ERR=CDX−RVL' or 'ERR=CDX−RVD'. For example, it is assumed that a dot is created in one pixel when the corrected data CDX of the pixel has a value '199' and the density evaluation value of the dot corresponds to the tone data '255'. In this case, there is a density error of 199−255=−56. This means that the density expressed in the pixel is too high.

The error diffusion process diffuses the error thus obtained into peripheral pixels near to the pixel of interest PP with the predetermined weights shown in FIG. 39. The error is diffused to non-processed pixels. In the case where the error is '−56', a value '−14', which corresponds to one quarter of the error '−56', is allocated to pixels adjoining to the pixel of interest PP that is currently being processed. The diffused error is reflected on the processing of step S110 with regard to a subsequent pixel P1. For example, when the tone data of the pixel P1 is equal to a value '214', the corrected data CDX has a value '200' by adding the diffused error '−14'. The CPU 81 carries out the series of the processing discussed above with regard to all the pixels (step S155). On conclusion of the processing with regard to all the pixels, the program exits from the halftone processing routine and returns to the dot creation control routine.

The CPU 81 outputs the data generated by the halftone processing together with the sub-scan feed data as the print data FNL to the printer PRT via a serial or parallel transfer cable.

Figure 40:
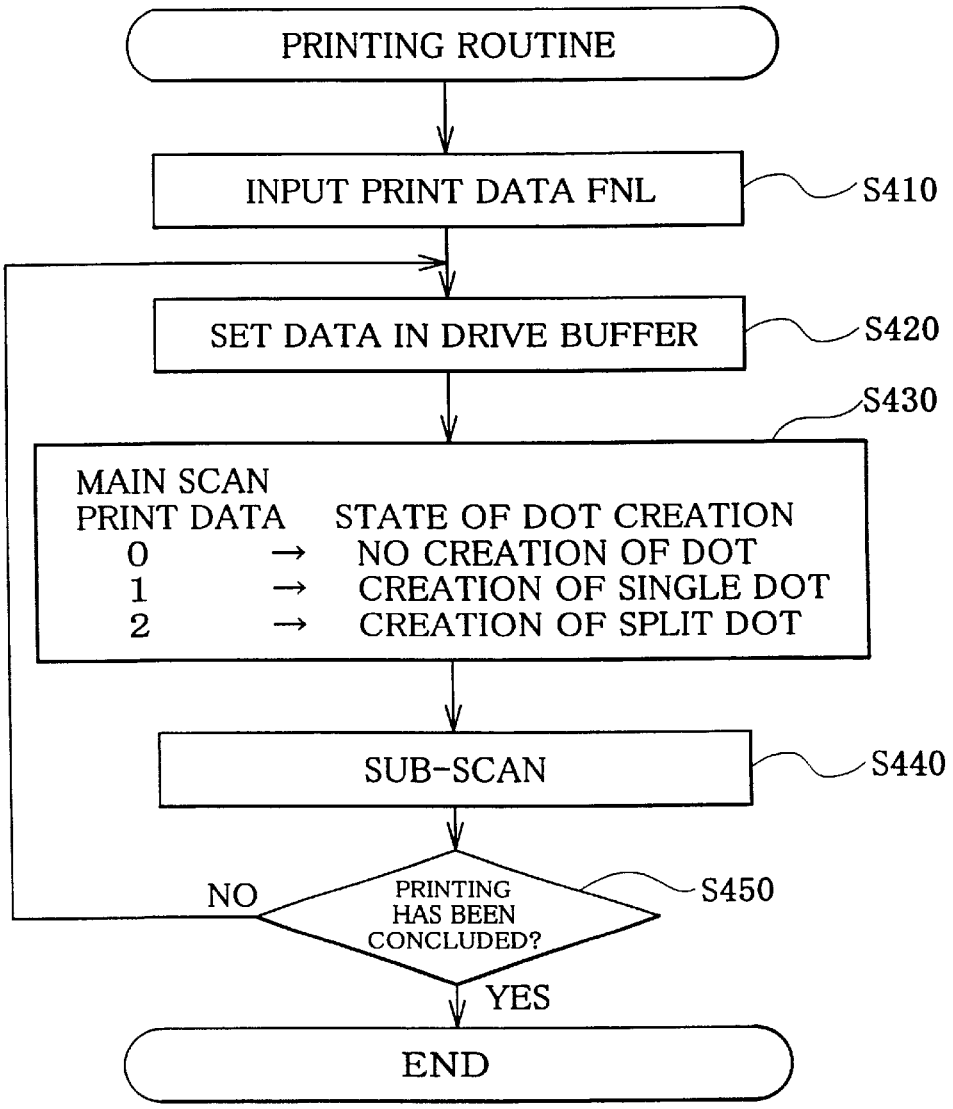
FIG. 40 is a flowchart showing a printing routine.

The printer PRT receives the transferred print data FNL and carries out a printing operation. The CPU 41 in the printer PRT executes a printing routine to implement the printing operation. FIG. 40 is a flowchart showing the printing routine. When the program enters this printing routine, the CPU 41 first receives the print data FNL (step S410). The CPU 41 temporarily stores the input print data FNL into the RAM 43 and carries out the subsequent series of the processing in parallel.

After the input of the print data FNL, the CPU 41 sets the data in the drive buffer 47 (step S420). The concrete procedure selects the print data corresponding to a raster line to be formed by each nozzle among the input print data FNL and stores the selected print data into the drive buffer 47. The CPU 41 then moves the carriage 31 to carry out one pass of the main scan and create dots, based on the stored print data (step S430). The dot creation state is changed over corresponding to the value of the print data. No dot is created in response to the print data equal to 0. The single dot is created in response to the print data equal to 1. The split dot is created in response to the print data equal to 2.

As described previously, the dot creation state is changed by selectively using one of the two driving waveforms. The CPU 41 controls the transmitter 50 to output the driving waveform corresponding to the printing medium.

On completion of one pass of the main scan, the CPU 41 carries out sub-scan to feed the printing paper by a preset amount (step S440). The feeding amount of sub-scan depends upon the nozzle pitch of the print head 28 and the print mode. The interlace recording method is adopted in this embodiment. The procedure of setting the feeding amount in the interlace method is known to the art and is thus not specifically described here. The CPU 41 repeatedly carries out the series of the processing discussed above to complete printing of the whole image (step S450).

The printing apparatus of the embodiment discussed above selectively uses the single dot DL and the split dot DD and enables expression of variable densities in the respective pixels. This arrangement ensures the smooth tone expression and improves the resulting image quality.

The printing apparatus of the embodiment has a variety of advantages as discussed below. The first advantage is that the printing apparatus of the embodiment enables a variation in density to be expressed in each pixel without varying the quantity of ink ejection. This ensures the smooth tone expression even in printing media of low duty restriction. This is explained with the graph of FIG. 3. In this embodiment, a split dot having two divisions is created with a quantity of ink q1. As clearly understood from the graph, a quantity of ink q2 is required to create a single dot corresponding to a total area Ar2 of the split dot. The quantity of ink q2 is about 1.4 times as large as the quantity of ink q1. The printing apparatus of the embodiment enhances the densities expressed in the respective pixels without causing any blot due to an increase in quantity of ink consumption. This arrangement naturally saves the total quantity of ink consumption.

The second advantage is that the printing apparatus of the embodiment ensures the variable tone expression with one type of ink. This effectively attains the smooth tone expression without expanding the size of the print head by a large number of different inks having different densities.

The above embodiment regards the case of creating dots with a substantially fixed quantity of ink. One possible modification may use dots created with different quantities of ink. A printing apparatus of this configuration is described below as a modified example.

Figure 41:
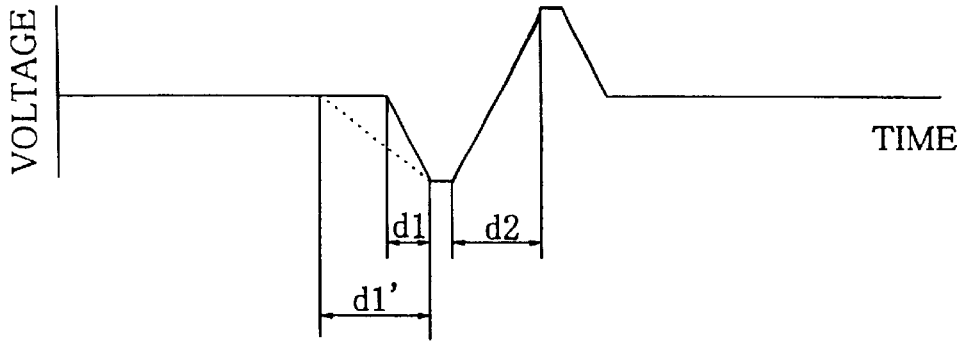
FIGS. 41, 41*a*,41*b*,41*c*, 41*a*', 41*b*' and 41*c*' show the principle of ejecting ink droplets with different quantities of ink.
Figures 41A, 41B, 41C:
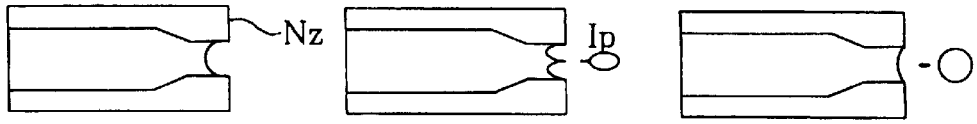
Figures 41A, 41B, 41C:
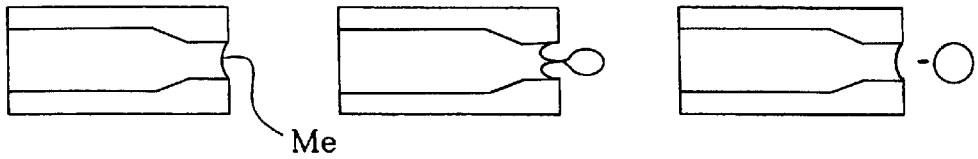

FIG. 41 shows the principle of ejecting ink droplets with different quantities of ink. As described previously, the driving waveform once lowers the voltage in the division d1. The behavior of the meniscus Me depends upon the slope of the voltage reduction. The gentle voltage reduction as shown in a division d1' enables the supply of ink to well follow the deformation of the ink conduit, compared with the abrupt voltage reduction. The meniscus Me is thus hardly concaved inward the nozzle as shown in a state a'. Ejection of ink in the subsequent division d2 in this state causes a larger ink droplet to be ejected (see states b' and c' in FIG. 41), compared with the ink droplet ejected in the state that the meniscus Me is significantly concaved inward the nozzle. The quantity of ink ejection is varied by selectively using one of two driving waveforms having different slopes in the division d1.

Figure 42:
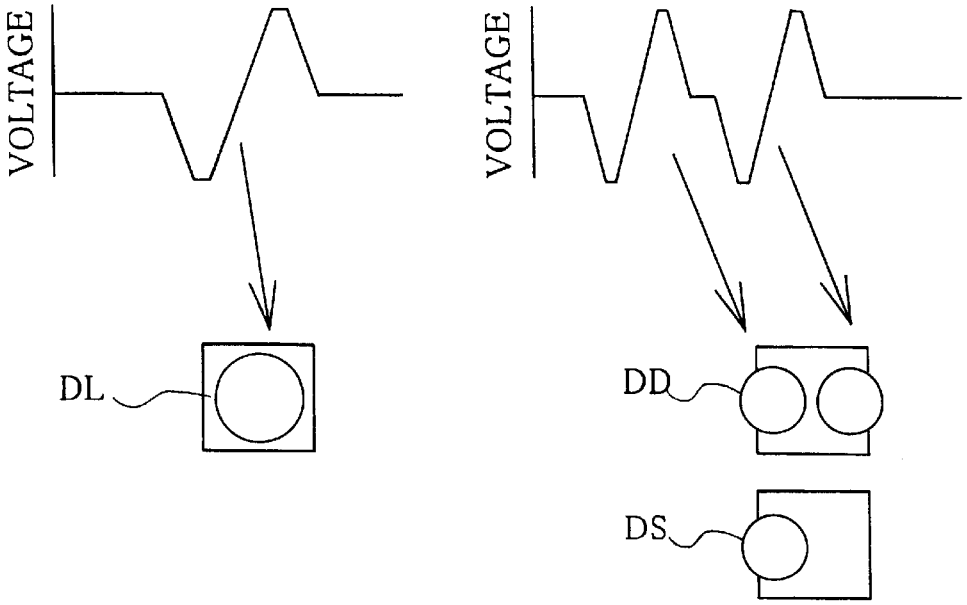
FIG. 42 shows driving waveforms used in a modified example.

The printing apparatus of the modified example varies the quantity of ink ejection and the number of waveforms corresponding to each pixel. FIG. 42 shows driving waveforms used in the modified example. The left-side drawing shows a first driving waveform. One large dot DL is created in each pixel with a large quantity of ink in response to the first driving waveform. The right-side drawing shows a second driving waveform. In response to the second driving waveform, one or a plurality of small dots are created, each with half the quantity of ink ejected by the first driving waveform. In the case of the second driving waveform, two waveforms are allocated to each pixel to enable creation of two dots. Two small dots DD, which correspond to divisions of the large dot DL, are created in response to the second driving waveform. When only one of the two waveforms in the second driving waveform allocated to each pixel is on, a single small dot DS is created in each pixel with half the quantity of ink used to create the dot DL in response to the first driving waveform.

Figure 3:
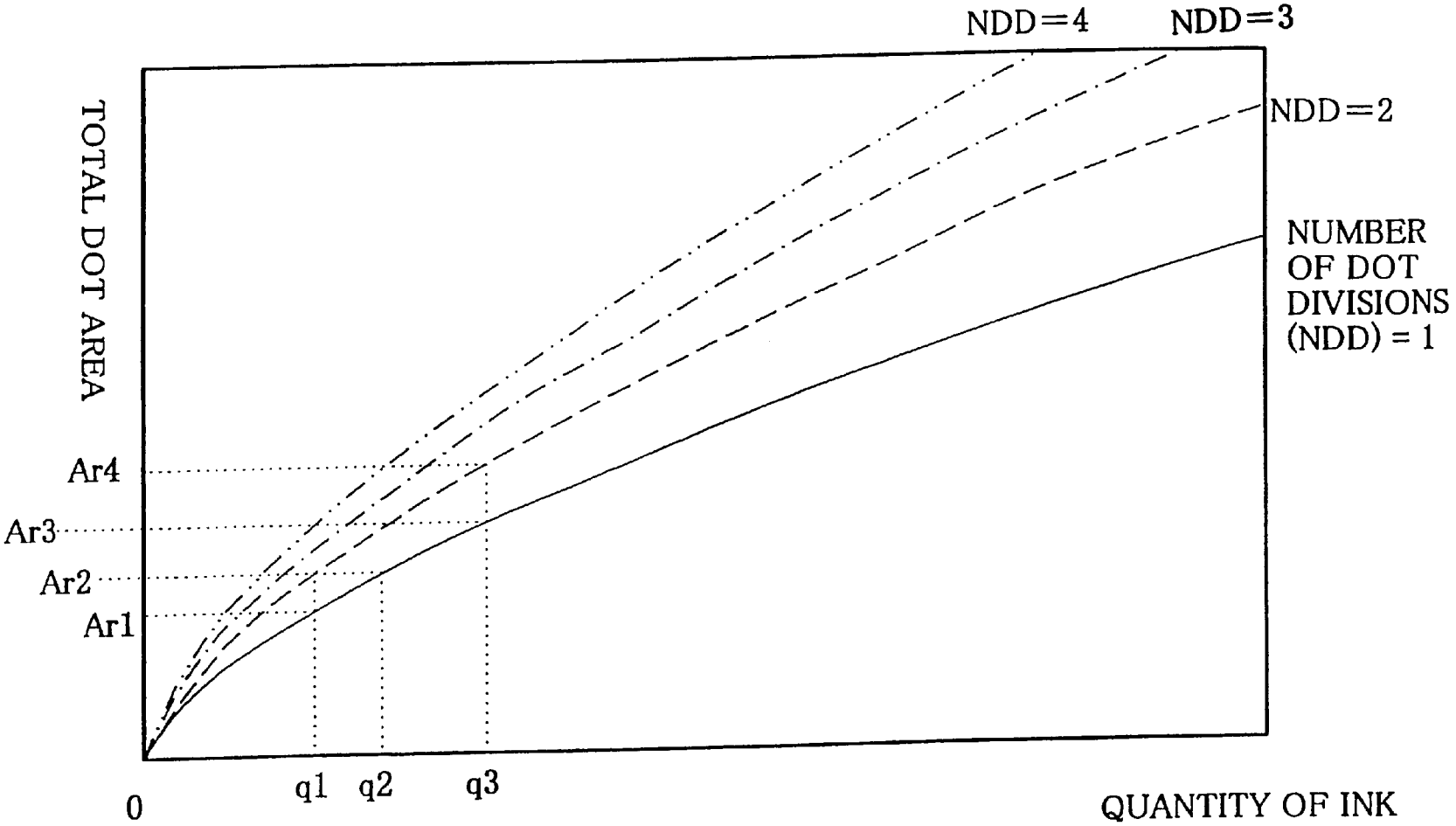
FIG. 3 is a graph showing the relationship between the number of dot divisions and the total dot area.

The printing apparatus of the modified example namely enables dots to be created in three different states, that is, the dots DS, DD, and DL. The density expressed by each type of the dot is described with referring to FIG. 3. In this example, it is assumed that the single small dot DS is created with a quantity of ink q1. The single small dot DS then expresses the density corresponding to the area Ar1. In the example of FIG. 3, a value q3 is double the quantity of ink q1. The single large dot DL is created with the quantity of ink q3 and expresses the density corresponding to the area Ar3. The two small dots DD constitute a split dot with the quantity of ink q3 and accordingly express the density corresponding to the area Ar4.

As described above, the printing apparatus of the modified example enables expression of the multiple densities in each pixel. This ensures the smooth tone expression and remarkably improves the image quality. The above modified example does not have a mode of further splitting the small dot DS into a plurality of divisions. Using the driving waveform that further splits the small dot DS into a plurality of divisions based on the principle described in the above embodiment enables expression of the density corresponding to the area Ar2 in FIG. 3. The arrangement of combining the variation in quantity of ink with the division of the dot enables expression of the multiple tones at finer intervals, thereby having the greater effects of improving the image quality. The effects are especially prominent in the low tone area, in which the subtle tone expression tends to significantly affect the image quality. Using inks of different densities in combination with this arrangement ensures the smoother tone expression.

C. Second Embodiment

The first embodiment describes the printing apparatus that selectively uses different dots having different dot creation states according to the halftone-processed tone values of the print data to attain the smooth tone expression. A second embodiment here describes a printing apparatus that selectively uses different dots having different dot creation states according to the type of the printing medium. The printing apparatus of the second embodiment has the similar hardware configuration as that of the first embodiment. The differences from the first embodiment are the details of the dot creation control process and the printing process. In the dot creation control routine, the contents of the color correction process (see step S30 in the flowchart of FIG. 37) are different from those of the first embodiment. The technique of the first embodiment carries out the color correction process using a common color correction table LUT. The technique of the second embodiment, on the other hand, selectively uses one of two color correction tables corresponding to the type of the printing medium.

Figure 43:
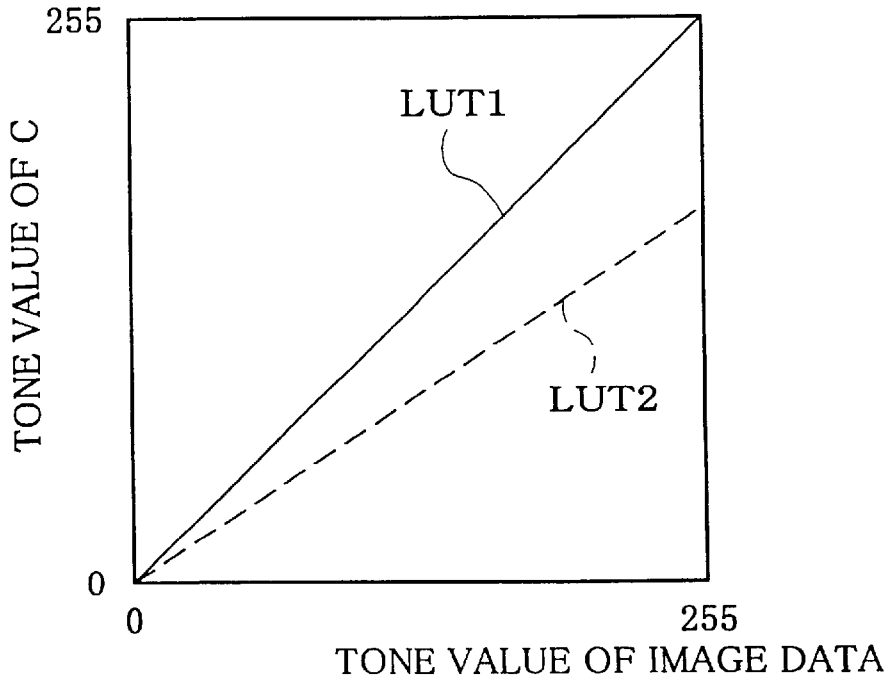
FIG. 43 shows part of data in color correction tables.

The following describes the settings of the two color correction tables LUT1 and LUT2 used in the second embodiment. FIG. 43 shows part of data in the color correction tables. The chart shows the part relating to the tone value of cyan (C). The tone value of the image data, which is actually expressed by the combination of the three-dimensional data R, G, and B, is plotted as abscissa. The data of FIG. 43 represents the relationship between the tone value of the image data and the tone value of C when the tone value of the image data is varied along a certain straight line in the three-dimensional color space consisting of the tone values of R, G, and B. The tone value of cyan (C) is a parameter equivalent to the dot recording rate of cyan (C). As shown in the chart, the two color correction tables LUT1 and LUT2 have different tone values of C. The color correction table LUT1 represents data corresponding to the printing medium of high ink permeability like plain paper, and the color correction table LUT2 represents data corresponding to the printing medium of restricted ink permeability like special paper.

Figure 44:
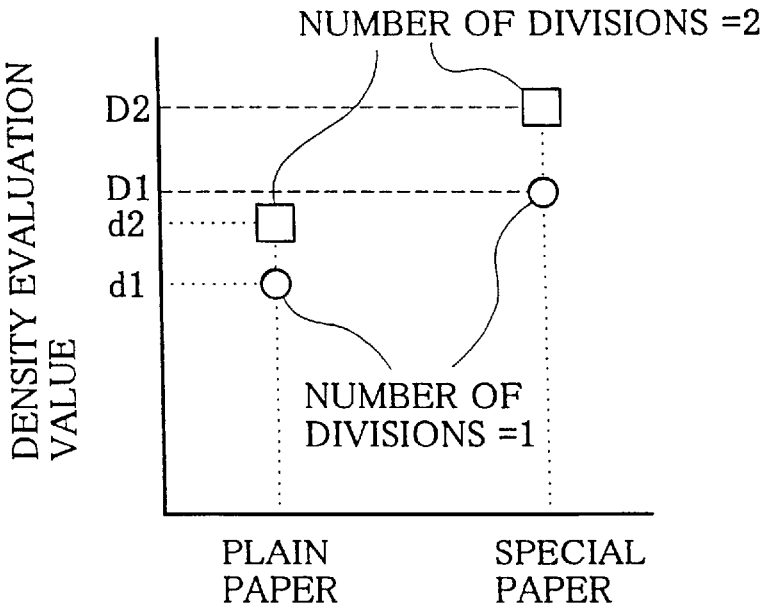
FIG. 44 is a graph showing the relationship between the density evaluation value and the type of the printing paper with regard to different numbers of dot divisions.

FIG. 44 is a graph showing the relationship between the density evaluation value and the type of the printing paper with regard to different numbers of dot divisions. The density evaluation value is a numerical expression of the density shown by each dot on the printing medium. The density evaluation values in the case of the 'number of divisions=1', that is, in the case of the single dot, are shown by the symbol of the closed circle with regard to both the plain paper and the special paper. The density evaluation values in the case of the 'number of divisions=2', that is, in the case of the split dot, are shown by the symbol of the closed square with regard to both the plain paper and the special paper. The density evaluation value is equal to d1 in the case of creating the single dot on the plain paper, and is equal to d2 in the case of creating the split dot on the plain paper. The density evaluation value is equal to D1 in the case of creating the single dot on the special paper, and is equal to D2 in the case of creating the split dot on the special paper.

As described previously, the increase in number of divisions enhances the density evaluation value in each of the printing media. The respective printing media, however, have different relationships between the density evaluation value and the resulting dot to be created. Ink more readily permeates the plain paper in the direction of its depth than the special paper, so that the density evaluation value d1 with regard to the single dot created on the plain paper is smaller than the density evaluation value D1 with regard to the single dot created on the special paper. Similarly the density evaluation value d2 with regard to the split dot created on the plain paper is smaller than the density evaluation value D2 with regard to the split dot created on the special paper. The comparison between the density evaluation value d2 with regard to the split dot created on the plain paper and the density evaluation value D1 with regard to the single dot created on the special paper depends upon the ink permeability of each printing medium. In the second embodiment, the value d2 is smaller than the value D1.

The technique of the second embodiment selects the dot creation state to ensure the substantially equivalent density evaluation values on the respective printing media. Based on the principle shown in FIG. 44, the split dot is created on the plain paper, whereas the single dot is created on the special paper. Creating the single dot on both the printing media causes a large difference in density evaluation value between d1 and D1. The technique of the second embodiment changes the dot creation state corresponding to the type of the printing medium, so as to compensate for the difference in density evaluation value due to the difference in ink permeability.

As shown in FIG. 44, there is still a small difference between the density evaluation values attained by the respective dot creation states. The technique of the second embodiment further compensates for this small difference by varying the dot recording rate according to the printing medium. The dot recording rate is readily varied by changing the color correction table. From this point of view, the second embodiment selectively uses one of the two color correction tables LUT1 and LUT2 corresponding to the printing medium. The density evaluation value d2 is smaller than the density evaluation value D1 as shown in FIG. 44. The color correction table LUT1 for the plain paper accordingly has the higher settings of the dot recording rate than those of the color correction table LUT2 for the special paper.

The density evaluation value with regard to each printing medium is varied by the dot creation state and the ink permeability. In some cases, the density evaluation value d2 shown in FIG. 44 may be greater than the density evaluation value D1. In such cases, the dot recording rates in the color correction table LUT1 for the plain paper are set to be lower than those in the color correction table LUT2 for the special paper. In other cases, there is no significant difference between the density evaluation value d2 and the density evaluation value D1. In such cases, a common color correction table may be used, regardless of the type of the printing medium.

As described above, the CPU 81 carries out the halftone processing with regard to each ink (see step S100 in FIG. 37) after the color correction process, which selectively uses either one of the color correction tables LUT1 and LUT2 corresponding to the printing medium. A variety of known methods, for example, the error diffusion method and the dither method, are applicable to the halftone processing. The series of the processing discussed in the fist embodiment (see FIG. 38) is applicable to the halftone processing based on the error diffusion method. For convenience of explanation, it is assumed that the second embodiment carries out the halftone processing to the binary values, that is, the dot-on and the dot-off states. This series of the processing is similar to the processing of the first embodiment (FIG. 38) by omitting the processes of steps S115 and S120. The second embodiment may, however, carry out the multi-valuing process to at least the trinary values, as in the case of the first embodiment.

Figure 45:
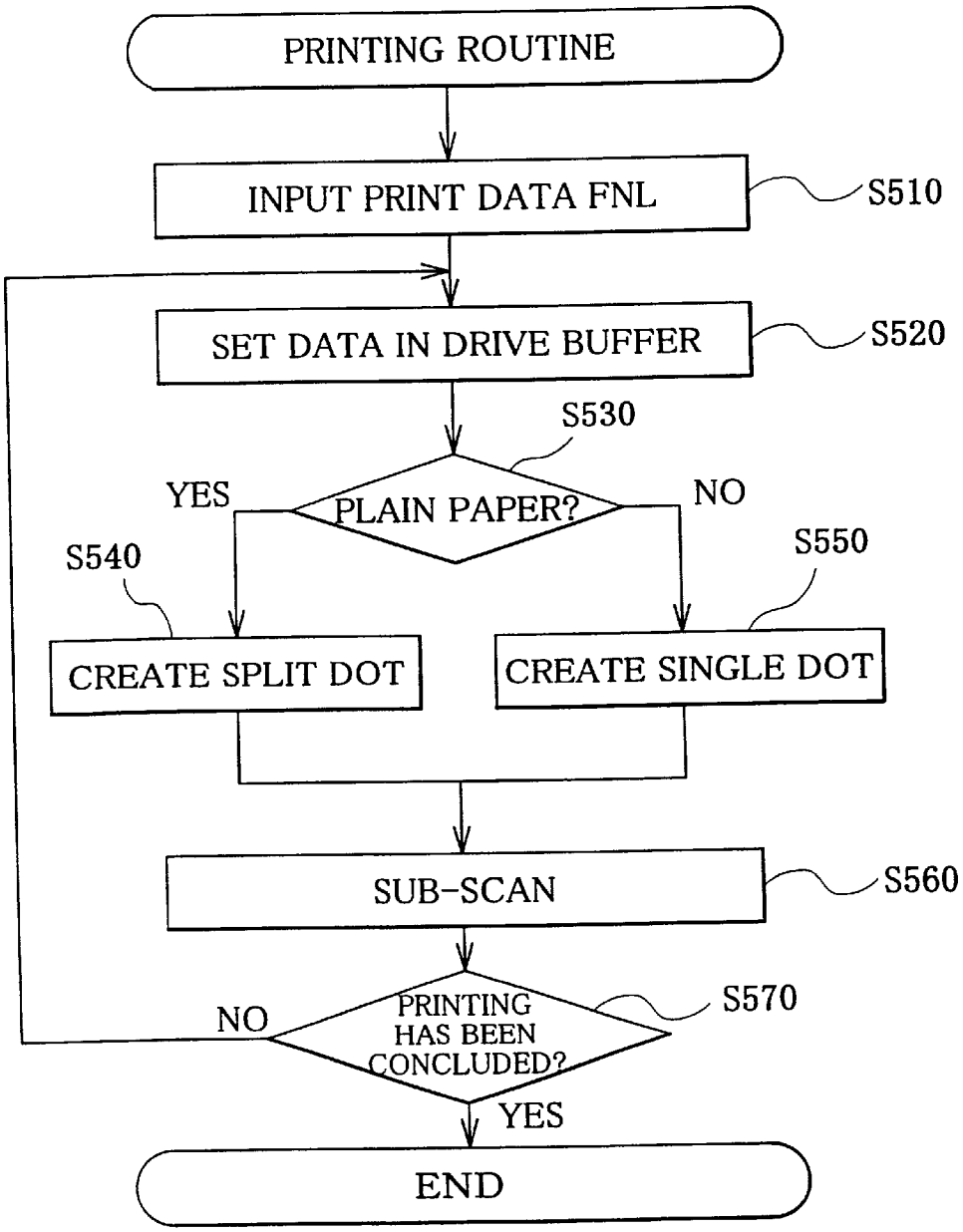
FIG. 45 is a flowchart showing a printing routine.

The printer PRT receives the transferred print data FNL and carries out the printing operation. The CPU 41 included in the printer PRT executes a printing routine to implement printing. FIG. 45 is a flowchart showing the printing routine. When the program enters this routine, the CPU 41 first receives the print data FNL (step S510). The print data FNL includes data specifying the print mode, such as the type of the printing medium. The CPU 41 temporarily stores the input print data into the RAM 43 and carries out the subsequent series of the processing in parallel.

After the input of the print data FNL, the CPU 41 sets the data in the drive buffer 47 (step S520). The concrete procedure selects the print data corresponding to a raster line to be formed by each nozzle among the input print data FNL and stores the selected print data into the drive buffer 47.

The CPU 41 subsequently determines whether or not the printing medium is plain paper (step S530). The process selectively uses the dot creation state according to the printing medium as discussed previously. When it is determined that the plain paper is specified, the CPU 41 moves the carriage for one pass of the main scan and creates the split dot (step S540). When it is determined that the special paper is specified, on the other hand, the CPU 41 carries out one pass of the main scan to create the single dot (step S550).

The dot creation state is changed by selectively using one of the two driving waveforms. The CPU 41 controls the transmitter 50 to output the driving waveform corresponding to the printing medium.

On completion of one pass of the main scan, the CPU 41 carries out sub-scan to feed the printing paper by a preset amount (step S560). The feeding amount of sub-scan depends upon the nozzle pitch of the print head 28 and the print mode. The interlace recording method is adopted in the second embodiment. The procedure of setting the feeding amount in the interlace method is known to the art and is thus not specifically described here. The CPU 41 repeatedly carries out the series of the processing discussed above to complete printing of the whole image (step S670).

The printing apparatus of the second embodiment discussed above selectively uses the single dot and the split dot according to the type of the printing medium, thus ensuring the appropriate tone expression suitable for the printing medium. Namely the difference in density due to the difference in ink permeability between the respective printing media is compensated by changing the dot creation state. The technique of the second embodiment carries out the compensation with the variation in dot recording density in combination with the change of the dot creation state, thus ensuring the more appropriate tone expression. The printing apparatus of the present invention thus enables printing to be carried out with the sufficiently high image quality in each printing medium. This arrangement significantly improves the image quality especially in the plain paper having the low duty restriction.

The second embodiment regards the arrangement of selectively using the dot creation state corresponding to each of the two different printing media, the plain paper and the special paper. Different dot creation states may be mapped to a greater number of printing media. One possible application maps the single dot to a set of printing media and the split dot to another set of printing media.

The second embodiment describes the binary printer that enables expression of only binary densities, that is, the dot-on and the dot-off states, in each pixel. The technique of the second embodiment may be applied to the multi-valued printers that enable expression of at least trinary densities in each pixel. In the multi-valued printers, for example, the split dots are created with the respective quantities of ink in the case of the plain paper, whereas the single dots are created with the respective quantities of ink in the case of the special paper. The appropriate dot creation state may be selectively used only for specific quantities of ink having a large difference in density expression due to the difference in ink permeability.

The second embodiment regards the arrangement of creating the split dot by changing the shape of the driving waveform (see FIG. 31). A variety of methods are applicable to create the split dot. For example, a first modified example of changing the dot creation state continuously forms two dots with half the quantity of ink to complete a split dot as described previously with FIGS. 41 and 42.

Figure 46:
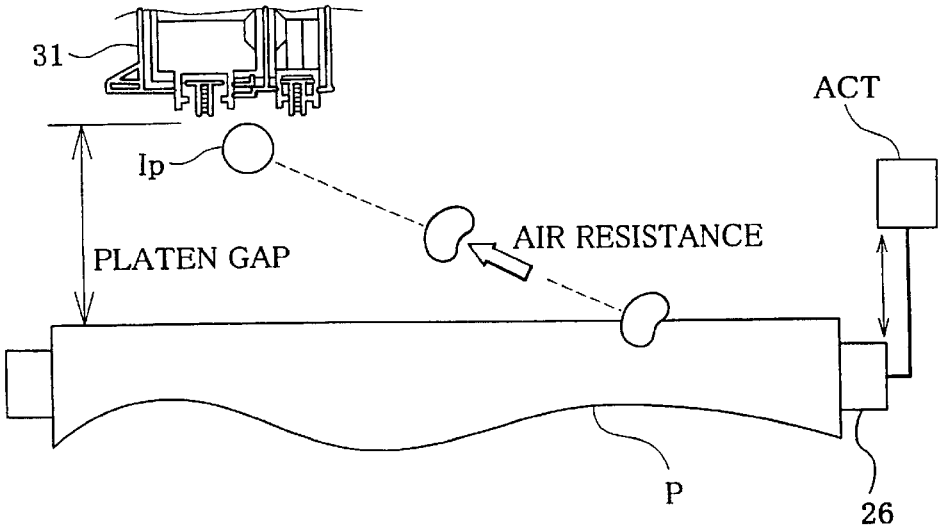
FIG. 46 shows the flying state of an ink droplet Ip ejected from a carriage 31.

The following describes a second modified example that varies the distance between the carriage 31 and the platen 26 to change the dot creation state. FIG. 46 shows the flying state of an ink droplet Ip ejected from a carriage 31. As illustrated, the ejected ink droplet Ip is deformed by the air resistance before hitting against the printing paper P. The degree of deformation is varied according to the distance between the carriage 31 and the printing paper P or the platen 26 (hereinafter referred to as the platen gap).

Figure 47:
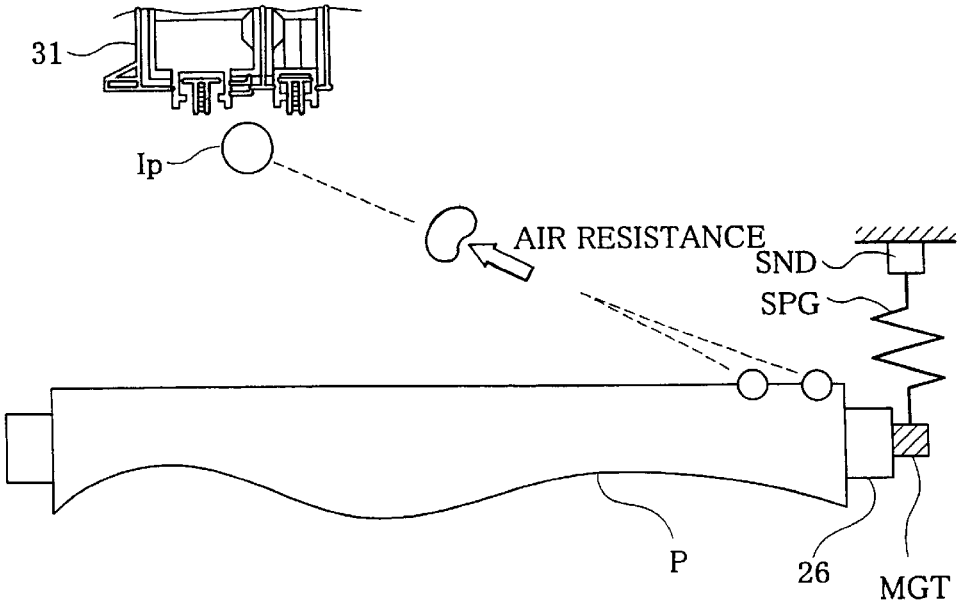
FIG. 47 shows the state of the ink droplet Ip under the condition of a large platen gap.

FIG. 47 shows the state of the ink droplet Ip under the condition of a large platen gap. The greater platen gap extends the working time of the air resistance and thereby enhances the degree of deformation of the ink droplet Ip. The resulting dot has the strained shape from the circle according to the magnitude of the platen gap. The density evaluation value of the dot varies with a variation in strain of the shape. When the platen gap exceeds a predetermined level, the ink droplet Ip is split into divisions as shown in FIG. 47. The dot creation state may be changed by adjusting the platen gap in this manner.

The platen gap may be adjusted by any of various methods. For example, as shown in FIG. 46, the bearing of the platen 26 is shifted by a power-driven actuator ACT in the direction perpendicular to the axis of the platen 26. Another applicable mechanism adjusts the platen gap between two stages, that is, wide and narrow positions, by means of a solenoid and a spring. In this mechanism, a permanent magnet MGT is mounted on the bearing of the platen 26, and a solenoid SND is fixed to the casing as shown in FIG. 47. A spring SPG is interposed between the casing and the bearing. When electricity is supplied to the solenoid SND in this structure, the attracting magnetic force works between the solenoid SND and the permanent magnet MGT and draws the platen 26 toward the solenoid SND to a predetermined distance against the elastic force of the spring SPG. This decreases the platen gap. At the stop of power supply, the magnetic force is deactivated, and the elastic force of the spring SPG causes the platen 26 to move away from the solenoid SND. This increases the platen gap. In accordance with one possible modification, the polarity of the permanent magnet MGT may be inverted. In this case, the platen gap increases at the time of power supply and decreases at the stop of power supply. The platen gap may be adjusted by any of these methods.

Figure 48:
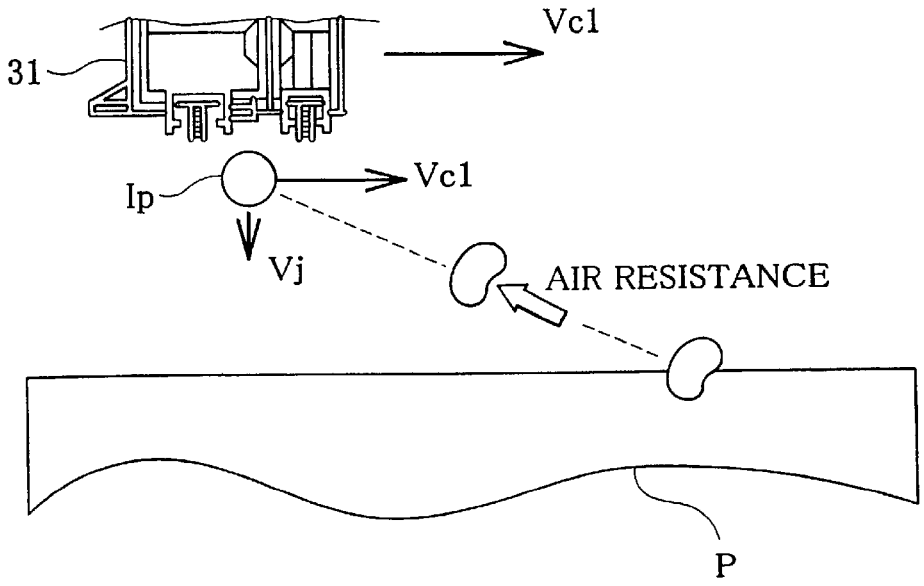
FIG. 48 shows the flying state of the ink droplet Ip in the case of a slow moving speed of the carriage 31.

The arrangement of varying the moving speed of the carriage 31 is described as a third modified example of changing the dot creation state. FIG. 48 shows the flying state of the ink droplet Ip in the case of a low moving speed of the carriage 31. The ejected ink droplet Ip is deformed by the air resistance before hitting against the printing paper P as illustrated. The ink droplet Ip is subjected to the air resistance having a composite velocity of a moving speed Vc1 of the carriage 31 and an ejecting speed Vj of the ink droplet Ip.

Figure 49:
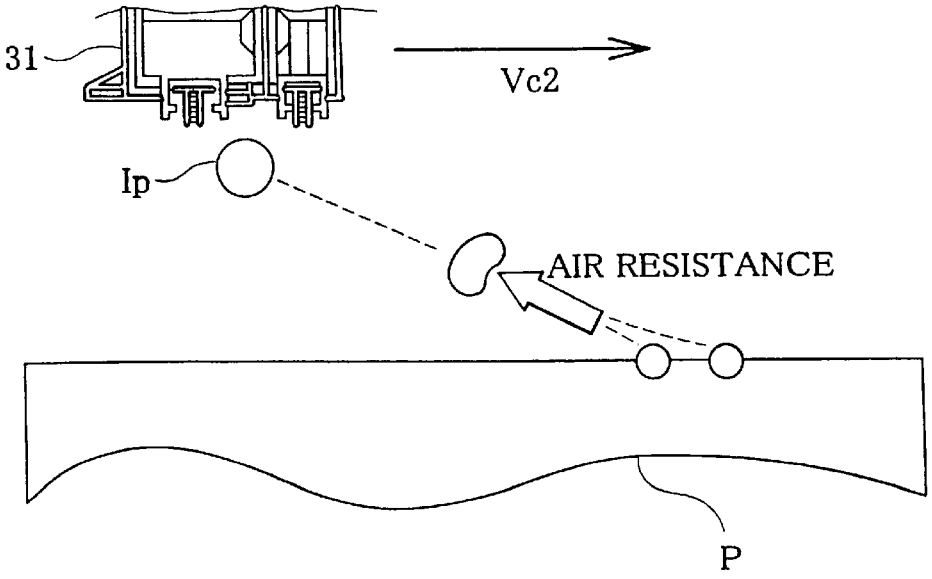
FIG. 49 shows the flying state of the ink droplet Ip in the case of a high moving speed of the carriage 31.

FIG. 49 shows the flying state of the ink droplet Ip in the case of a high moving speed of the carriage 31. As is generally known, the air resistance is proportional to the second power of the velocity. When the moving speed of the carriage 31 is raised from Vc1 to Vc2, the greater air resistance acts on the ink droplet Ip. The dot of the strained shape from the circle is thus formed according to the moving speed of the carriage 31. The density evaluation value of the dot is varied with a variation in strain of the shape. When the moving speed of the carriage 31 exceeds a predetermined level, the ink droplet Ip is split into divisions as shown in FIG. 49. The dot creation state may be changed by adjusting the moving speed of the carriage 31 in this manner.

The movement of the carriage 31 is regulated by the carriage motor 24. A stepping motor is applied for the carriage motor 24 to regulate the position of the carriage 31 in the main scanning direction with a high accuracy. The moving speed of the carriage 31 is relatively easily regulated by varying the frequency of the control pulse output to the carriage motor 24. The dot creation state may be changed by a variety of other methods.

The present invention is not restricted to the above embodiments or their modifications, but there may be many other modifications, changes, and alterations without departing from the scope or spirit of the main characteristics of the present invention. For example, the series of control processes described in the embodiments may partly or wholly be attained by a hardware configuration.

Industrial Applicability

The technique of the present invention is preferably applied to a printing apparatus that ejects ink and creates dots to print a multi-tone image, and is especially effective in a printing apparatus that enables expression of at least trinary tone values with regard to each pixel.

What is claimed is:

1. A print head that pressurizes ink in an ink conduit, through which a supply of ink is fed from an ink tank to a nozzle, so as to cause ink to be ejected from said nozzle and create a dot, said print head comprising:

a pressure variation unit that varies a pressure applied to the ink in said ink conduit; and a driving unit that controls said pressure variation unit to apply the pressure to the ink along a preset pressure waveform, said driving unit varying a parameter relating to a pressure reduction, so as to enable different dots to be created in different dot creation states with a substantially identical quantity of ink.

2. A print head in accordance with claim 1, wherein the different dot creation states have different numbers of dot divisions.

3. A print head in accordance with claim 1, wherein the preset pressure waveform includes a high pressure section to apply a high pressure to the ink and a subsequent reducing pressure section to subsequently reduce the pressure.

4. A print head in accordance with claim 3, wherein the parameter is a timing of starting the reducing pressure section.

5. A print head in accordance with claim 3, wherein the parameter is a quantity of pressure reduction in the reducing pressure section.

6. A print head in accordance with claim 3, wherein the parameter is a rate of change in pressure in the reducing pressure section.

7. A print head in accordance with claim 1, wherein the preset pressure waveform includes a high pressure section to apply a high pressure to the ink and a pre-reducing pressure section to reduce the pressure prior to the high pressure section, and the parameter is a quantity of pressure reduction in the pre-reducing pressure section.

8. A print head in accordance with claim 1, wherein said pressure variation unit changes a cross section of said ink conduit, so as to vary the pressure applied to the ink.

9. A print head in accordance with claim 8, wherein said pressure variation unit comprises an electrostrictive element that is disposed adjacent to said ink conduit to generate a predetermined strain in response to an applied voltage, and said driving unit regulates the voltage applied to said electrostrictive element.

10. A printing apparatus that ejects ink and creates a dot in each pixel on a printing medium, so as to print a multi-tone image, said printing apparatus comprising:

an input unit that inputs halftone-processed print data; and a dot creation unit that selectively uses one of a plurality of preset different dots according to the input print data and creates the selected dot in each pixel, wherein the plurality of preset different dots include at least two different dots corresponding to a plurality of dot creation states having different areas with a substantially equivalent quantity of ink.

11. A printing apparatus in accordance with claim 10, wherein said dot creation unit comprises:

a nozzle from which ink is ejected;

an ink conduit through which a supply of ink is fed from an ink tank to said nozzle;

a pressure variation unit that varies a pressure applied to the ink in said ink conduit; and a driving unit that controls said pressure variation unit to apply the pressure to the ink along a preset pressure waveform, said driving unit varying a parameter relating to a pressure reduction, so as to ensure creation of dots in the plurality of dot creation states.

12. A printing apparatus in accordance with claim 11, wherein the plurality of dot creation states have different numbers of dot divisions.

13. A printing apparatus in accordance with claim 11, wherein the preset pressure waveform includes a high pressure section to apply a high pressure to the ink and a subsequent reducing pressure section to subsequently reduce the pressure.

14. A printing apparatus in accordance with claim 13, wherein the parameter is a timing of starting the reducing pressure section.

15. A printing apparatus in accordance with claim 13, wherein the parameter is a quantity of pressure reduction in the reducing pressure section.

16. A printing apparatus in accordance with claim 13, wherein the parameter is a rate of change in pressure in the reducing pressure section.

17. A printing apparatus in accordance with claim 11, wherein the preset pressure waveform includes a high pressure section to apply a high pressure to the ink and a prereducing pressure section to reduce the pressure prior to the high pressure section, and the parameter is a quantity of pressure reduction in the pre-reducing pressure section.

18. A printing apparatus in accordance with claim 11, wherein said pressure variation unit changes a cross section of said ink conduit, so as to vary the pressure applied to the ink.

19. A printing apparatus in accordance with claim 18, wherein said pressure variation unit comprises an electrostrictive element that is disposed adjacent to said ink conduit to generate a predetermined strain in response to an applied voltage, and said driving unit regulates the voltage applied to said electrostrictive element.

20. A printing apparatus in accordance with claim 10, wherein said dot creation unit comprises:

an ink ejection unit that is capable of varying a quantity of ink per ejection; and a driving unit that controls said ink ejection unit to change a quantity, a frequency, and a position of ink ejection and thereby ensure creation of dots in the plurality of dot creation states.

21. A printing apparatus that creates dots on a printing medium, so as to print a multitone image, said printing apparatus comprising:

an input unit that inputs print data halftone-processed to a preset number of tone values;

a dot creation state changing unit that changes over a dot creation state among different dot creation states having different densities expressed with a substantially identical quantity of ink;

a printing medium input unit that inputs a type of a printing medium;

a storage unit that stores a mapping of each tone value of the print data to each of the different dot creation states with regard to each printing medium; and a control unit that controls said dot creation state changing unit based on the mappings stored in said storage unit and enables dots to be created in a selected dot creation state according to the input type of the printing medium.

22. A printing apparatus in accordance with claim 21, wherein the mapping stored in said storage unit maps a dot creation state attaining expression of a higher density to a printing medium having a lower quantity of ink absorbable per unit area.

23. A printing apparatus in accordance with claim 21, wherein said dot creation state changing unit changes a number of dot divisions from an ejected ink droplet, so as to enable dots to be created in the different dot creation states having different densities.

24. A printing apparatus in accordance with claim 21, wherein said dot creation state changing unit gives a local speed difference to an ink droplet ejected, so as to change the dot creation state.

25. A printing apparatus in accordance with claim 21, wherein said dot creation state changing unit varies a distance between a print head, from which ink is ejected, and the printing medium, so as to change the dot creation state.

26. A printing apparatus in accordance with claim 21, said printing apparatus further comprising:

a main scan unit that moves back and forth a print head, from which ink is ejected, relative to said printing medium to carry out main scan, wherein said dot creation state changing unit varies a moving speed of the main scan, so as to change the dot creation state.

27. A method of creating a dot in each pixel on a printing medium, so as to print a multi-tone image with a printing apparatus, which comprises a dot creation state changing unit that changes a dot creation state among different dot creation states having different densities expressed with a substantially identical quantity of ink, said method comprising the steps of:

(a) inputting print data halftone-processed to a preset number of tone values;

(b) inputting a type of a printing medium; and (c) referring to data that are set in advance to represent a mapping of each tone value of the print data to each of the different dot creation states with regard to each printing medium, and enables dots to be created in a selected dot creation state according to the type of the printing medium.

28. A method of driving a print head, said print head having a pressure variation unit that varies a pressure applied to ink in an ink conduit, through which a supply of ink is fed from an ink tank to a nozzle, said print head causing ink to be ejected from said nozzle and create a dot by pressurizing the ink with said pressure variation unit, said method regulating a parameter relating to a reducing pressure section included in a preset waveform and thereby controlling a dot creation state while keeping a substantially it identical quantity of ink, when said pressure variation unit is driven to vary the pressure along the preset waveform including the reducing pressure section to reduce the pressure.

29. A recording medium, in which a specific program is recorded in a computer readable manner, said specific program being executed to drive a printing apparatus having a dot creation state changing unit that changes over a dot creation state among different dot creation states having different densities expressed with a substantially identical quantity of ink, said specific program comprising mapping data representing a mapping of each tone value of print data to each of the different dot creation states with regard to each printing medium said specific program causing a computer to attain the functions of:

inputting a type of a printing medium, on which an image is printed; and controlling said dot creation state changing unit, based on the mapping data.

* * * * *